US010534308B2

(12) United States Patent
Ikeda et al.

(10) Patent No.: US 10,534,308 B2
(45) Date of Patent: Jan. 14, 2020

(54) TRANSMISSION DEVICE FOR A PHOTOSENSITIVE DRUM

(71) Applicants: Mitsubishi Chemical Corporation, Chiyoda-ku (JP); General Plastic Industrial Co., Ltd., Taichung County (TW)

(72) Inventors: Shuichi Ikeda, Chiyoda-ku (JP); Yohei Matsuoka, Tokyo (JP)

(73) Assignees: Mitsubishi Chemical Corporation, Chiyoda-ku (JP); General Plastic Industrial Co., Ltd., Taichung County (JP)

( * ) Notice: Subject to any disclaimer, the term of this patent is extended or adjusted under 35 U.S.C. 154(b) by 186 days.

(21) Appl. No.: 15/714,740

(22) Filed: Sep. 25, 2017

(65) Prior Publication Data

US 2018/0039222 A1 Feb. 8, 2018

Related U.S. Application Data

(63) Continuation of application No. PCT/JP2016/059270, filed on Mar. 23, 2016, which is a continuation of application No. 14/666,954, filed on Mar. 24, 2015, now abandoned.

(51) Int. Cl.
*G03G 15/00* (2006.01)
*G03G 21/18* (2006.01)

(52) U.S. Cl.
CPC ..... *G03G 15/757* (2013.01); *G03G 21/186* (2013.01)

(58) Field of Classification Search
CPC ..... G03G 15/757; G03G 21/1647; G03G 2221/1657; G03G 21/186; G03G 21/18; F16H 55/02
See application file for complete search history.

(56) References Cited

U.S. PATENT DOCUMENTS 8,615,184 B2 12/2013 Zhou et al.
9,031,465 B2 5/2015 Huang
9,091,994 B2 7/2015 Huang
9,091,995 B2 7/2015 Huang
(Continued)

FOREIGN PATENT DOCUMENTS

CN 102445892 A 5/2012
CN 103279022 A 9/2013
(Continued)

OTHER PUBLICATIONS

Office Action dated Nov. 8, 2018 in European Patent Application No. 16 768 844.9, 5 pages.
(Continued)

*Primary Examiner* — Francis C Gray
(74) *Attorney, Agent, or Firm* — Oblon, McClelland, Maier & Neustadt, L.L.P.

(57) ABSTRACT

A transmission device includes a gear member, an intermediate member removably attached to the gear member and including a guiding groove, and a transmitter including a shaft, the shaft having at least one protrusion extending radially outward from the shaft, and the guiding groove is shaped such that the protrusion is movable along the guiding groove in an axial direction and rotatable relative to the guiding groove.

6 Claims, 48 Drawing Sheets

(56) References Cited

U.S. PATENT DOCUMENTS

| | | | | |
|---|---|---|---|---|
| 9,098,048 | B2 | 8/2015 | Huang | |
| 2008/0152388 | A1 | 6/2008 | Ueno et al. | |
| 2008/0260428 | A1 | 10/2008 | Ueno et al. | |
| 2011/0091239 | A1 | 4/2011 | Ueno et al. | |
| 2011/0217073 | A1* | 9/2011 | He | G03G 15/757 399/111 |
| 2012/0080987 | A1 | 4/2012 | Takamori | |
| 2012/0183331 | A1* | 7/2012 | Huang | G03G 15/757 399/167 |
| 2013/0064569 | A1 | 3/2013 | Ueno et al. | |
| 2013/0071141 | A1 | 3/2013 | Ueno et al. | |
| 2013/0164031 | A1 | 6/2013 | Ueno et al. | |
| 2013/0322923 | A1 | 12/2013 | Ikeda | |
| 2014/0041476 | A1* | 2/2014 | Huang | F16D 3/2052 74/434 |
| 2014/0056613 | A1 | 2/2014 | Ueno et al. | |
| 2014/0064783 | A1 | 3/2014 | Ueno et al. | |
| 2014/0086634 | A1 | 3/2014 | Ueno et al. | |
| 2014/0099144 | A1 | 4/2014 | Ueno et al. | |
| 2015/0030353 | A1* | 1/2015 | Wang | F16D 3/06 399/167 |
| 2015/0050048 | A1* | 2/2015 | Huang | G03G 15/757 399/167 |
| 2015/0050050 | A1* | 2/2015 | Huang | G03G 21/1857 399/167 |
| 2015/0053032 | A1 | 2/2015 | Yamazaki et al. | |
| 2015/0185693 | A1* | 7/2015 | Wang | G03G 21/1857 399/111 |
| 2015/0346670 | A1 | 12/2015 | Ueno et al. | |
| 2016/0018777 | A1 | 1/2016 | Iijima et al. | |
| 2016/0274536 | A1 | 9/2016 | Ueno et al. | |
| 2016/0282798 | A1* | 9/2016 | Matsuoka | G03G 15/757 |
| 2017/0090405 | A1 | 3/2017 | Ueno et al. | |
| 2017/0090406 | A1 | 3/2017 | Ueno et al. | |
| 2017/0090407 | A1 | 3/2017 | Ueno et al. | |
| 2017/0090408 | A1 | 3/2017 | Ueno et al. | |
| 2017/0090409 | A1 | 3/2017 | Ueno et al. | |
| 2017/0090410 | A1 | 3/2017 | Ueno et al. | |
| 2017/0090411 | A1 | 3/2017 | Ueno et al. | |
| 2017/0090414 | A1 | 3/2017 | Ueno et al. | |
| 2017/0185027 | A1 | 6/2017 | Ueno et al. | |
| 2017/0185033 | A1 | 6/2017 | Ueno et al. | |
| 2017/0192384 | A1 | 7/2017 | Ueno et al. | |
| 2017/0192386 | A1 | 7/2017 | Ueno et al. | |
| 2017/0227925 | A1 | 8/2017 | Ueno et al. | |
| 2017/0227927 | A1 | 8/2017 | Ueno et al. | |
| 2018/0004155 | A1 | 1/2018 | Ueno et al. | |
| 2018/0017933 | A1* | 1/2018 | Zhou | G03G 15/0896 |

FOREIGN PATENT DOCUMENTS

| | | | |
|---|---|---|---|
| CN | 103376696 | A | 10/2013 |
| CN | 103454874 | A | 12/2013 |
| EP | 2 829 919 | A1 | 1/2015 |
| JP | 2006-227098 | | 8/2006 |
| JP | 2011-100171 | | 5/2011 |
| JP | 2012-73559 | | 4/2012 |
| JP | 2014-167656 | A | 9/2014 |
| JP | 2014-191025 | | 10/2014 |
| WO | WO 2012/113269 | | 8/2012 |
| WO | WO 2012/113299 | | 8/2012 |

OTHER PUBLICATIONS

Written Opinion of International Search Report dated Jun. 7, 2016 in PCT/JP2016/059270 (with English Translation).

Extended Search Report dated Jan. 30, 2018 in European Patent Application No. 16768844.9, 8 pages.

International Search Report dated Jun. 7, 2016 in PCT/JP2016/059270.

Combined Office Action and Search Report dated Dec. 7, 2018 in Chinese Patent Application No. 201680017661.2, 15 pages (with English translation).

European Office Action dated Aug. 6, 2019, in Patent Application No. 16 768 844.9, 5 pages.

* cited by examiner (a)

(b)

(a)

(b)

(a)

(b)

FIG.22A
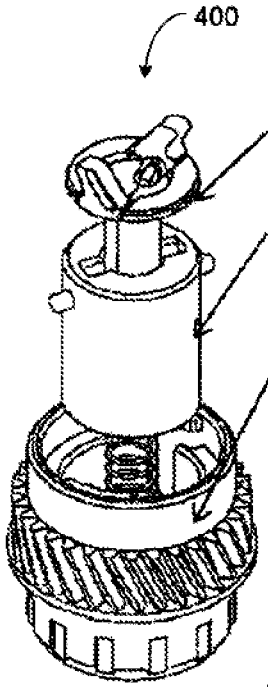
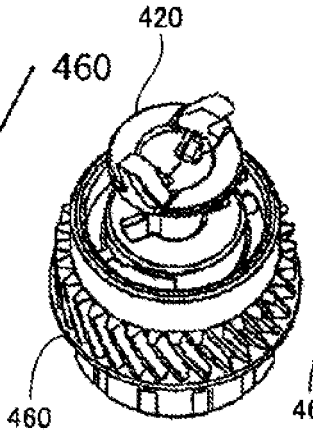
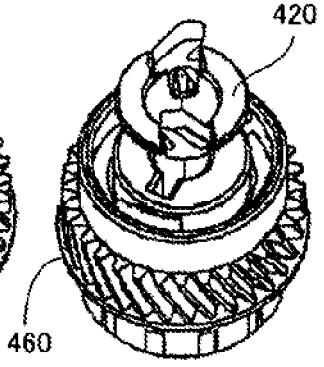
FIG.22B FIG.22C

FIG.25A
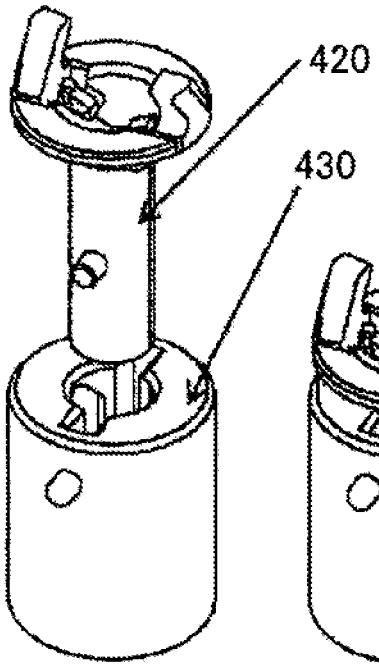
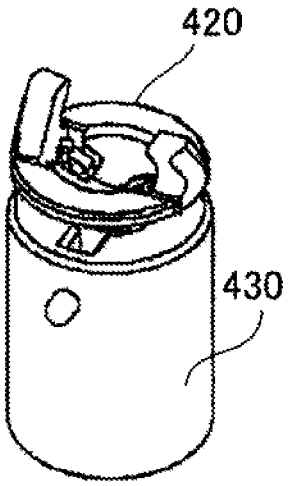
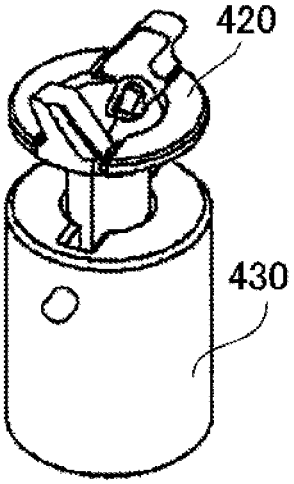
FIG.25B FIG.25C

FIG.26A
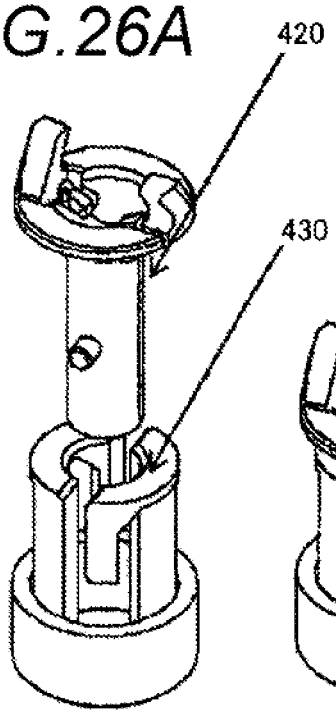
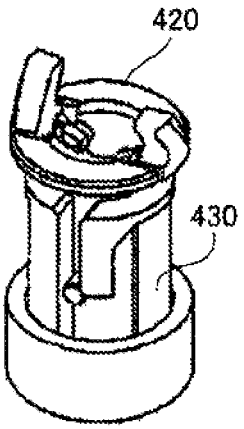
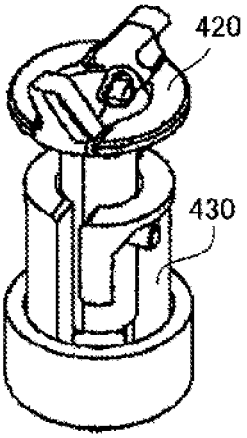
FIG.26B FIG.26C
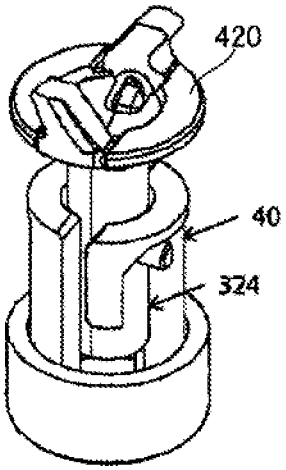
FIG.26D

FIG.27A
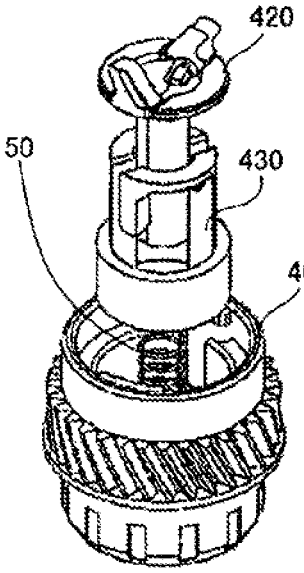
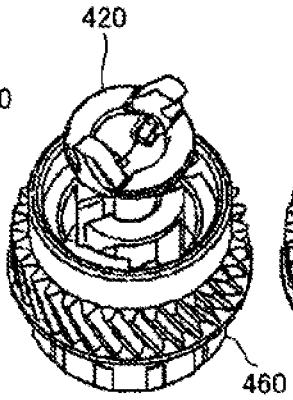
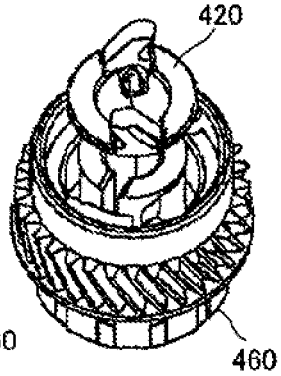
FIG.27B FIG.27C

TRANSMISSION DEVICE FOR A PHOTOSENSITIVE DRUM

CROSS REFERENCE TO RELATED APPLICATION(S)

This application is a continuation of international application No. PCT/JP2016/059270 filed on Mar. 23, 2016 based upon and claiming the benefit of priority of U.S. application Ser. No. 14/666,954 filed on Mar. 24, 2015, the contents of which are incorporated herein by reference in its entirety.

BACKGROUND OF THE INVENTION

1. Field of the Invention

The present invention relates to a transmission device for a photosensitive drum.

2. Description of the Related Art

As image forming apparatuses, a copying machine, a laser printer and the like are listed.

Usually, an image forming apparatus is provided with a process cartridge so as to be demountably mountable on the body of the image forming apparatus (hereinafter, sometimes referred to as "apparatus body"). For example, the process cartridge is provided by including a photosensitive drum and at least one of a developing device, a charging device and a cleaning device as a unit in a cartridge.

As current process cartridges, the followings are listed: a type including a photosensitive drum, a developing device, a charging device and a cleaning device as a unit in a cartridge; a type including a photosensitive drum and a charging device as a unit in cartridge; and a type including, as a unit cartridge, a photosensitive drum and two developing units consisting of a charging device and a cleaning device.

The above-described process cartridge can be demountably mounted on the apparatus body by the user, and it is unnecessary to ask for a professional's help. Therefore, the user's operability to the maintenance of the image forming apparatus is improved. The mechanism of a rotational driving force received from the apparatus body in order to rotate the photosensitive drum in the above-described conventional process cartridge is shown below.

On the body side, a rotatable member for transmitting a driving force of a motor and a non-circular twisted hole situated at a center portion of the rotatable member and having a cross section rotatable integrally with the rotatable member are provided. The part including the non-circular twisted hole having the cross section rotatable integrally with the rotatable member has a plurality of corners.

On the process cartridge side, a non-circular twisted projection is present, and the twisted projection is provided at any of the longitudinal ends of the photosensitive drum and has a cross section provided with a plurality of corners. When the process cartridge is mounted on the apparatus body and the rotatable member is rotated in a state of being engaged between the projection and the hole, the rotational driving force of the rotatable member is transmitted to the photosensitive drum. As a result, the rotational force for driving the photosensitive drum is transmitted from the apparatus body to the photosensitive drum. Another known mechanism is to drive the photosensitive drum by engaging a gear fixed to the photosensitive drum to thereby drive the process cartridge constituting the photosensitive drum.

The inventions described in Patent Literatures 1 to 3 disclose conventional arrangements of photosensitive drum driving components. These driving components couple the photosensitive drum to the apparatus body and transmit the rotational force from the apparatus body as shown later.

FIG. 46 shows an embodiment of a photosensitive drum 10 having a driving component 1. The driving component 1 (or a transmission device) is fixed at one end of a main drum body 21 of the photosensitive drum 10. The main drum body 21 has a photosensitive layer at its peripheral surface. The driving component 1 is used to receive a rotational driving force from a printer's driving mechanism and transmit the rotational driving force to the main drum body 21. The main drum body 21 rotates around its axis under the rotational driving force.

FIG. 47 to FIG. 49 show the basic construction of the driving component 1. The driving component 1 mainly includes a gear 2, a rotational driving force receiver 3, a regulating slider 4, a groove part 5, a rotation limiting pin 6, a central shaft part 9, a position limit clevis pin 7 and a helical compression spring 8. The gear 2 is fixed at one end of the main drum body 21. The axis of the gear 2 coincides with the axis of the main drum body. The rotational driving force receiver 3 is connected to the regulating slider 4 through the rotation limiting pin 6. The rotational driving force receiver 3 can rotate reciprocally around its axis within a certain angular range relative to the regulating slider 4.

The groove part 5 is a cylinder with a top that has an upper chute penetrating in the radial direction and a bottom that has a lower chute penetrating in the radial direction. A base of the regulating slider 4 can reciprocally slide along the radial direction inside the upper chute relative to the groove part 5. The head of the central shaft part 9 can reciprocally slide along the radial direction inside the lower chute relative to the groove part 5.

The gear 2 includes a positioning base within its cavity. The positioning base includes a drum shaped hole. The size and shape of the drum shaped hole are substantially identical to the size and shape of the cross section of the rod portion of the central shaft part 9. Thus, once assembled, the central shaft part 9 can only move longitudinally within the drum shaped hole of the gear 2.

The helical compression spring 8 is set on the central shaft part 9 prior to assembly with the gear 2. The central shaft part 9 is assembled inside the gear 2 by passing the rod portion through the drum shaped hole in the gear 2 and inserting the position limit clevis pin 7.

The rotational driving force receiver 3, the regulating slider 4, the rotation limiting pin 6, the groove part 5 and the central shaft part 9 include a longitudinal regulating component 11. As can be seen in FIG. 50A to FIG. 50D, the longitudinal regulating component 11 can limit a longitudinal and reciprocal translational movement along the longitudinal direction Z of the gear 2 relative to the gear 2 via the compressed force of the helical compression spring 8. The compressed force is a force after losing the external force from the helical compression spring 8, and the longitudinal position is limited by the position limit clevis pin 7.

FIG. 50A to FIG. 50D are schematic diagrams showing the process in which a process cartridge assembled with the driving component 1 (only the end of the photosensitive drum is shown) is engaged into a printer. The process cartridge is engaged into the printer along the direction Xa perpendicular to the axis of the photosensitive drum. In a case where the driving component 1 initially contacts one of the claws extending from the rotational driving force receiver 3, the printer's driving shaft 13 pushes the rotational driving force receiver 3 to rotate a certain angle around its axis until the printer's driving shaft 13 passes through the section between the claws while pushing the driving component 1 so as to move overall along the direction Za.

In a case where the driving component 1 initially contacts some part of the section between the claws, the primes driving shaft 13 causes the driving component 1 to move overall along the direction Za without rotating.

The moving displacement of the longitudinal adjustment component 11 in the driving component 1 overall along the direction Za gradually increases as the printer's driving shaft 13 moves in the direction Xa. After the printer's driving shaft 13 contacts the edge of a peripheral surface on the receiving face of receiver 3, the longitudinal regulating component 11 in the driving component 1 moves overall along the direction Zb until the top of the printer's driving shaft 13 substantially coincides with the spherical surface.

In another embodiment, as shown in FIG. 51, claws 42 that extend from the rotational driving force receiver 3 are rotatable. Thus, when the printer's driving shaft 13 contacts one of the claws 42, the claw 42 rotates to provide clearance for the printer's driving shaft 13 to pass over the claw 42 and enter a central opening 417 of the driving force receiver 3. After the printer's driving shaft 13 passes over the claw 42, the claw 42 is returned to its upright position by a spring 44.

When the printer starts, the printer's driving shaft 13 is automatically coupled with the rotational driving force receiver 3, and receives the rotational driving force from the printer to rotate the main drum body 21 of the photosensitive drum.

Patent Literature 1: U.S. Pat. No. 8,615,184

Patent Literature 2: WO 2012/113299

Patent Literature 3: WO 2012/113289

Patent Literature 4: U.S. patent application Ser. No. 14/617,473

Patent Literature 5: U.S. patent application Ser. No. 13/965,856

Patent Literature 6: U.S. patent application Ser. No. 14/310,615

Patent Literature 7: U.S. patent application Ser. No. 14/461,011

SUMMARY OF THE INVENTION

In the conventional transmission device, the gear and the body of the drum are fixed and the assembly between the gear member and the transmitter cannot be performed with flexibility. Accordingly, in view of such circumstances, a problem set by the present invention is to provide a transmission device for a photosensitive drum capable of performing the assembly between the gear member and the transmitter with ease.

Hereinafter, some aspects of the present invention will be described.

The present invention provides, as one aspect, a transmission device including: a gear member; an intermediate member removably attached to the gear member and including a guiding groove; and a transmitter including a shaft, the shaft having at least one protrusion extending radially outward from the shaft, wherein the guiding groove is shaped such that the protrusion is moveable along the guiding groove in an axial direction and rotatable relative to the guiding groove.

In one aspect of the transmission device according to the present invention, for example, the intermediate member includes an introducing groove on a top face of the intermediate member and at least one retention member that forms the guiding groove, and the introducing groove provided on the top face of the intermediate member is sized to allow the protrusion to pass through the introducing groove when the transmitter is assembled to the intermediate member.

In one aspect of the transmission device according to the present invention, for example, the guiding groove includes an opening to allow the protrusion to pass through the introducing groove when the transmitter is assembled to the intermediate member.

In one aspect of the transmission device according to the present invention, for example, at least one inner wall ledge and at least one receiving member are provided on an inside surface of the gear member, the intermediate member includes at least one protrusion extending radially outward, and the receiving member of the gear member includes an opening to receive the protrusion of the intermediate member.

In one aspect of the transmission device according to the present invention, for example, the opening of the receiving member of the gear member is arranged such that the intermediate member is removably attached within the gear member by axially inserting the intermediate member into the gear member and rotating the gear member until the protrusion of the intermediate member is positioned within the opening of the receiving member.

In one aspect of the transmission device according to the present invention, for example, the at least one retention member of the intermediate member includes a first retention member and a second retention member disposed apart from the first retention member with a gap being formed from the first retention member, and the gap is sized to allow the protrusion to pass through the gap after passing through the introducing groove when the transmitter is assembled to the intermediate member.

The transmission device receives a rotational driving force from a printer to rotate a photosensitive drum. In the embodiments described herein, the transmission device includes the gear member, the intermediate member disposed on the gear member and the transmitter that is assembled to the intermediate member and transmits the driving force from the printer. According to the present invention, the intermediate member, the gear member and the transmitter can be assembled more flexibly than those of the conventional transmission device.

It is favorable that the intermediate member can be detached from the gear, for example, in repairing or replacing either of the components.

BRIEF DESCRIPTION OF THE DRAWINGS

FIG. 19A to FIG. 19F are views showing one embodiment of a transmitter and its assembly process.

FIG. 22A to FIG. 22C are views showing one embodiment of a transmission device and its assembly process.

FIG. 25A to FIG. 25C are views showing one embodiment of an assembly process of an intermediate member and a transmitter of a transmission device.

FIG. 26A to FIG. 26D are views showing one embodiment of an assembly process of an intermediate member and a transmitter of a transmission device.

FIG. 27A to FIG. 27C are views showing one embodiment of a transmission device and its assembly process.

DETAILED DESCRIPTION OF THE EXEMPLARY EMBODIMENTS

Figure 1:
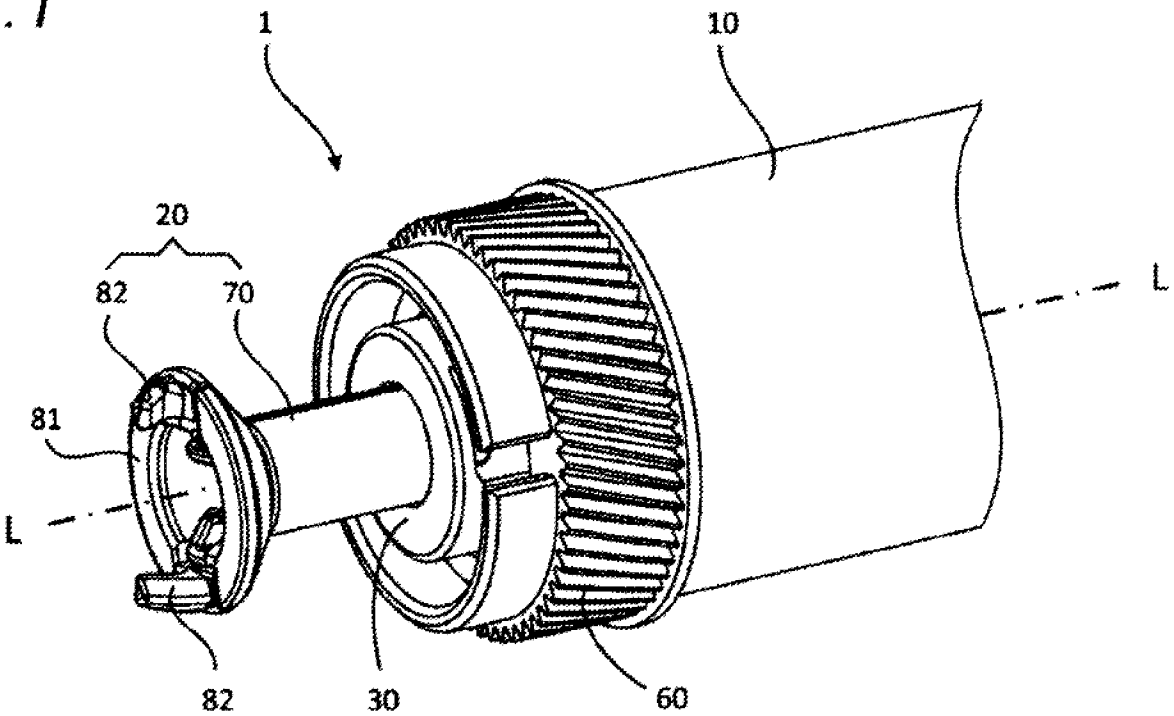
FIG. 1 is a perspective view schematically showing one embodiment of a drum device (unit).

Hereinafter, the present invention will be described based on embodiments shown in the drawings. However, the present invention is not limited to these embodiments. In some embodiments described below, an intermediate member is removably assembled with the gear member. For example, the intermediate member can be secured by a snap fit, friction, an interference fit, or sonic welding. A sleeve is an example of the intermediate member. Moreover, a transmitter removably assembled with the intermediate member can freely rotate and move relative to the intermediate member. The transmitter may be assembled either before or after the intermediate member is assembled with the gear member. As an example, the transmission device includes a gear member, an intermediate member removably attached to the gear member and having a guiding groove, and a transmitter including a shaft and at least one protrusion extending radially outward from the shaft. The guiding groove is shaped such that the protrusion is moveable within the guiding groove in an axial direction and rotatable relative to the guiding groove.

FIG. 1 is a perspective view schematically shoving an embodiment of a drum unit (device) described in Cited Document 4.

The drum unit includes a photosensitive drum 10 having a drum axis L and a driving component (transmission device 1) detachably attached to the photosensitive drum 10 coaxially to the drum axis L. The transmission device 1 is used to receive a rotational driving force from a driving mechanism of an image forming apparatus and transmit the rotational driving force to the photosensitive drum 10. The photosensitive drum 10 rotates around the drum axis L by this rotational driving force.

In the present embodiment, the transmission device 1 includes a shell 60 detachably attached to one end of the photosensitive drum 10 coaxially to the drum axis L, an intermediate member 30 coupled with the shell 60 coaxially to the drum axis L, and the transmitter 20 disposed to the intermediate member coaxially to the drum axis L. In one embodiment, the intermediate member 30 is integrally formed with the shell 60 coaxially to the drum axis L.

The transmitter 20 includes a shaft 70, a base 81, and at least two engagement blocks 82. The shaft 70 is rotatable about the drum axis L relative to the intermediate member 30 and movable along the drum axis L relative to the intermediate member 30. The base 81 is integrated with the shaft 70, and extends from one end of the shaft 70. The at least two engagement blocks 82 extend from both, sides of the base 81 away from the drum axis L so as to be rotatable around pivotal axes provided at both sides of the base 81. The pivotal axes of the engagement blocks 82 are axes perpendicular to the drum axis L. Various embodiments of the transmission device will be described below.

Figure 2A:
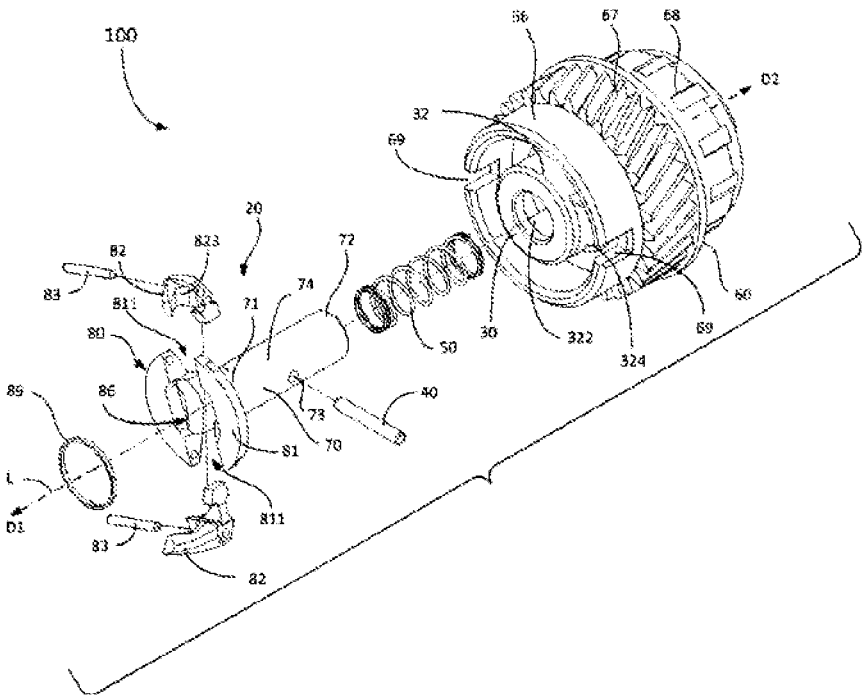
FIG. 2A is an exploded perspective view showing one embodiment of a transmission device used in a drum device.
Figure 2B:
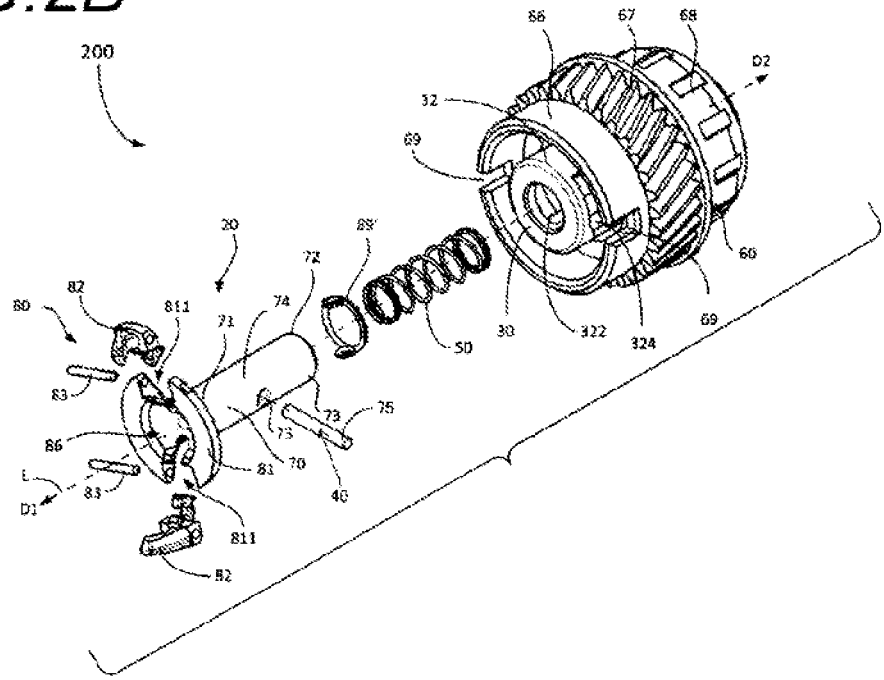
FIG. 2B is an exploded perspective view showing another embodiment of a transmission device used in a drum device.

FIG. 2A shows one embodiment of a transmission device 100. The transmission device 100 includes the transmitter 20, the intermediate member 30, an elastic member 50 and the gear member (shell) 60. FIG. 2B shows a transmission device 200 as another embodiment of the transmission device. While the transmission device 200 is essentially the same as the transmission device 100 of FIG. 2A, an elastic ring (an elastic member, a holding member) 89 used in the transmission device 100 and an elastic ring (an elastic member, a holding member) 89' used in the transmission device 200 are different in configuration (see FIG. 3A and FIG. 3B).

As shown in FIG. 2A, FIG. 2B and FIG. 4A to FIG. 10F, the transmitter 20 includes the shaft 70 and an engagement structure 80. The shaft 70 includes a cylindrical shaft body 74 and at least one protrusion 75 extending along a radial direction of the cylindrical shaft body 74. The shaft 70 has a cylindrical shaft body 74 and at least one protrusion 75 extending along a radial direction of the cylindrical shaft body 74. The shaft body 74 is an elongated element extending along the drum axis L and provided with a first end 71 facing toward a first direction D1, a second end 72 facing toward a second direction D2 opposite to the first direction D1, and an opening 73 penetrating through the body portion of the shaft body 74 along the radial direction of the shaft body 74. In one embodiment, a pin 40 is inserted into the opening 73 when assembled. When this is done, the protrusion 75 which is a part of the pin 40 sticks out of the opening 73.

The engagement structure 80 includes a base 81 integrated with the first end 71 of the shaft 70 and extending from the first end 71 and a notched receptacle 811 defined in the base 81. The base 81 has two pairs of holes 812 defined in communication with the notched receptacle 811.

Figure 4A:
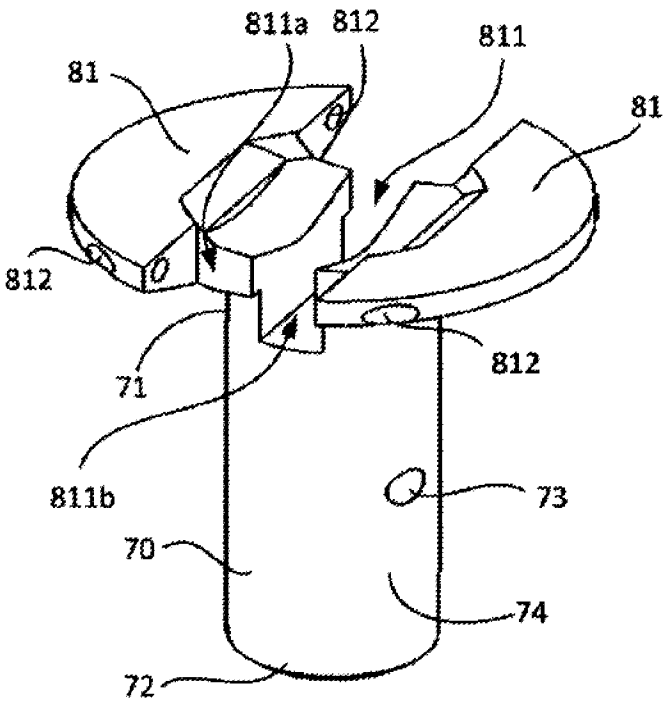
FIG. 4A is a partial perspective view showing one embodiment of a transmitter used in a transmission device.
Figure 4B:
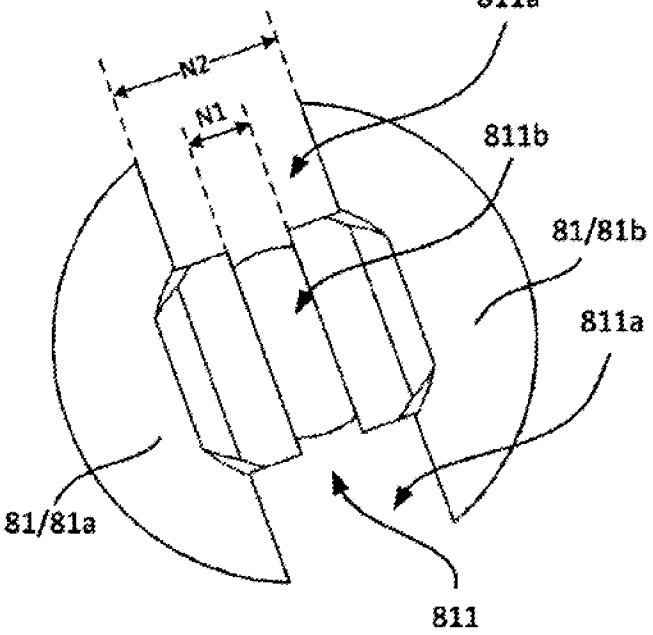
FIG. 4B is a partial top view showing one embodiment of the transmitter used in the transmission device.
Figure 5A:
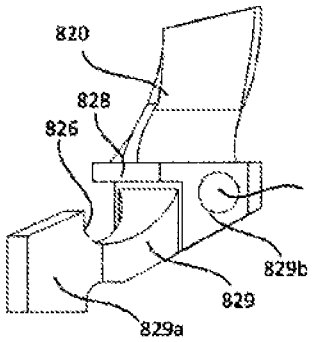
FIG. 5A to FIG. 5D are perspective views showing one embodiment of an engagement block of a transmitter used in a transmission device.
Figure 5B:
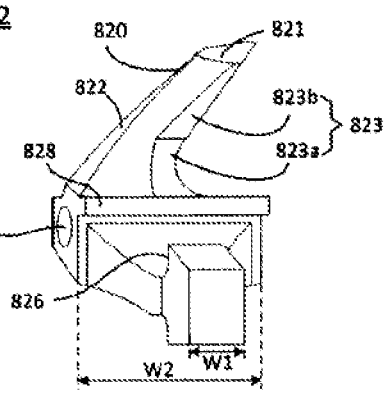
Figure 5C:
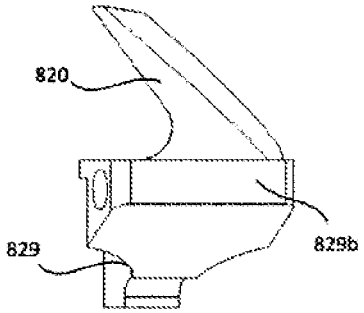
Figure 5D:
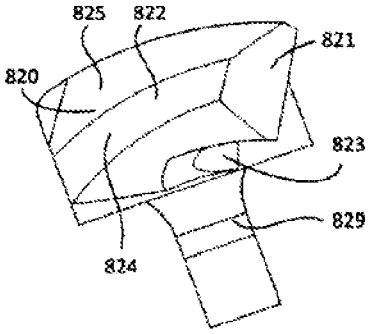
Figure 7B:
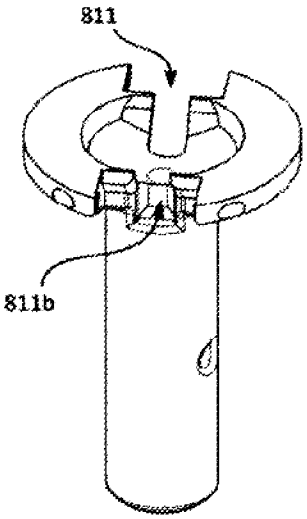
FIG. 7A to FIG. 7C are views partially showing one embodiment of transmitter used in a transmission device.
Figure 7A:
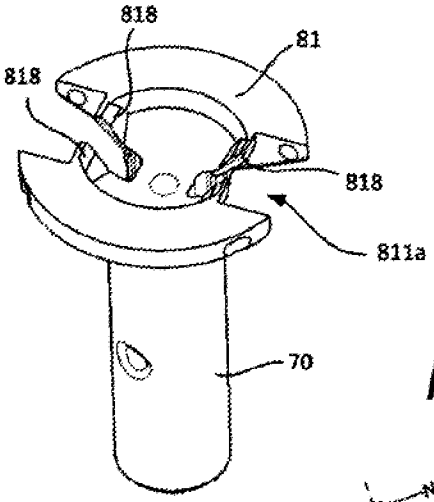
Figure 7C:
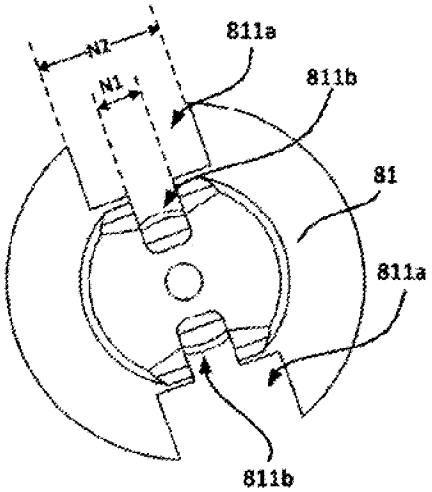
Figure 8A:
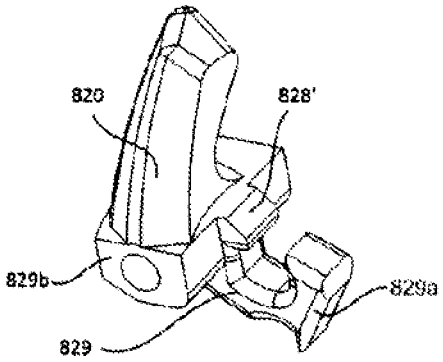
FIG. 8A to FIG. 8D are perspective views showing one embodiment of an engagement block of a transmitter used in a transmission device.
Figure 8B:
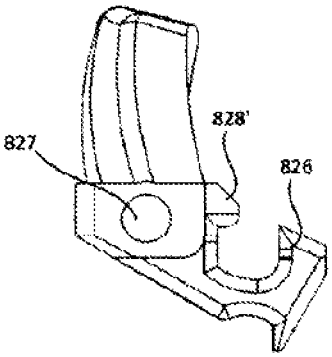
Figure 8C:
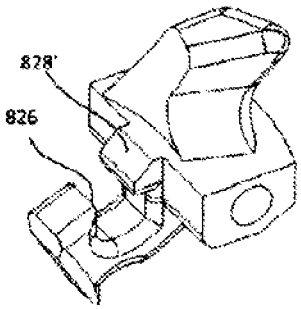
Figure 8D:
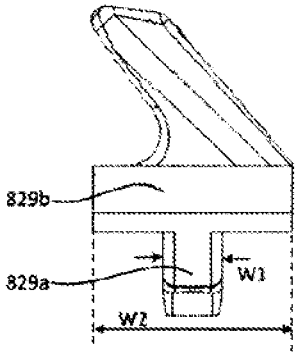

As shown in FIG. 4A, 4B and FIG. 7A to FIG. 7C, the notched receptacle 811 has two openings 811*a* provided symmetrically on both sides of the base 81 and two grooves 811*b*. As shown in FIG. 7A to FIG. 7C, the grooves 811*b* are provided at the base 81 and at the first end portion 71 of the shaft 70, respectively, and are in communication with the two openings 811*a*, respectively. The width of the grooves 811*b* is N1, and the width of the openings 811*a* is N2. The width N1 of the grooves 811*b* is narrower than the width N2 of the openings 811*a*. In one embodiment, as shown in FIG. 7A to FIG. 7C, the notched receptacle 811 has wall portions 818. The wall portions 818 are provided to prevent the engagement blocks 82 from over-rotating toward the drum axis L in operation. Moreover, as shown in FIG. 4A and FIG. 4B, a structure may be adopted in which the two grooves 811*b* is formed as one groove and the base 811 is divided into two portions 81*a* and 81*b* (base portions).

As shown in FIG. 5A to FIG. 5D, the engagement structure 80 also includes the two engagement blocks 82. In the present embodiment, the engagement blocks 82 are L-shaped. Other types and shapes of engagement blocks (for example, linear, U-shaped, C-shaped, J-shaped, etc.) may also be used for the present invention.

As shown in FIG. 5A to FIG. 5D and FIG. 8A to FIG. 8D, each engagement block 82 has a bottom member 829 and an engagement claw 820. The bottom member 829 has a first end portion 829*a* forming a hook 826 and a second end portion 829*b* on the opposite side. The engagement claw 820 extends upwards (or vertically) from the second end portion 829*b* of the bottom member 829. The two engagement blocks 82 are pivotally received at both sides of the notched receptacle 811, respectively. Thereby, each engagement block 82 is rotatable around a pivotal axis perpendicular to the drum axis L at the second end portion 829*b* of the bottom member 829, the first end portion 829*a* of the bottom member 829 faces toward the drum axis L and the engagement claw 820 faces helically toward the first direction D1 in a normal state. The two engagement blocks 82 define therebeteween a receiving space 86 for receiving a drive member (driving mechanism) of an image forming apparatus.

As shown in FIG. 5A to FIG. 5D and FIG. 8A to FIG. 8D, each engagement block 82 has an outer surface 825 extending in the first direction D1 to gradually approach the drum axis L, an inner surface 824 facing the receiving space 86, an inclined top surface 822 at a junction between the outer surface 825 and the inner surface 824, an engagement concave 823 at another junction between the outer surface 825 and the inner surface 824, and a vertex 821 located between the inclined top surface 822 and the engagement concave 823. The angle between the extending direction of the inclined top surface 822 and the drum axis L is about 30 to 80 degrees. The engagement concaves 823 of the engagement blocks 82 are opened substantially toward opposite directions for allowing pillars 92 of the drive member of the image forming apparatus to enter the engagement concaves 823 through openings of the engagement concaves 823. Each engagement concave 823 has an arched recess 823*a* and a limiting surface 823*b* located between the recess 823*a* and the vertex 821 and substantially inclined from the vertex 821 toward the inclined top surface 822. The engagement concaves 823 of the engagement blocks 82 are opened substantially toward opposite directions.

As shown in FIG. 5A to 5D and FIG. 8A to 8D, the widths of the first end portion 829*a* and the second end portion 829*b* of the bottom member 829 of each engagement block 82 are a first width W1 and a second width W2, respectively. The first width W1 is narrower than the second width W2.

In some embodiments, the hook 826 of each engagement block 82 is a T-shaped hook. Moreover, as shown in FIG. 5A to FIG. 5D and FIG. 8A to FIG. 8D, each engagement block 82 also has a through hole 827 at the second end portion 829*b* of the bottom member 829. The through hole 827 is coincident with the pivotal axis.

Further, each engagement block 82 has a rotation control member 828. The rotation control member 828 is formed in the second end portion 829*b* of the bottom member 829 and faces toward the first end portion 829*a* of the bottom member 829. In one embodiment, as shown in FIG. 5A to FIG. 5D, the rotation control member 828 extends from one side to the other side of the second end portion 829*b* of the bottom member 829, and its width is the same (W2) as the width of the second end portion 829*b* of the bottom member 829. However, in another embodiment, as shown in FIG. 8A to FIG. 8D, a rotation control member 828' extends from the middle of the second end portion 829*b* of the bottom member 829, and its width is essentially the same (W1) as the width of the first end portion 829*a* of the bottom member 829 and narrower than the second width (W2) of the second end portion 829*b* of the bottom member 829.

Figure 3A:
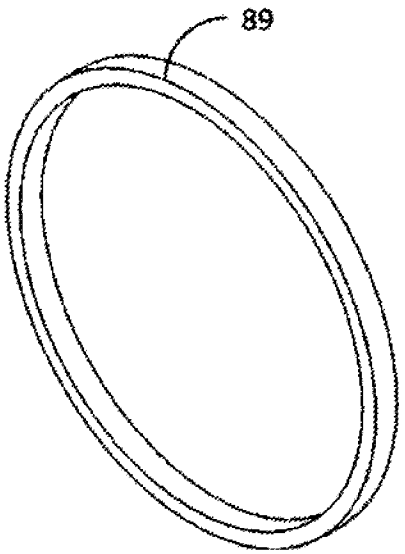
FIG. 3A and FIG. 3B are perspective views showing one embodiment of a holding member used in a transmission device.
Figure 3B:
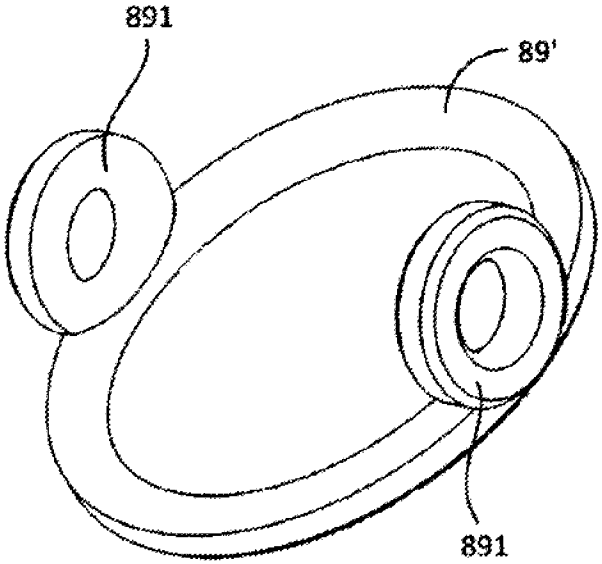

Further, the engagement structure 80 includes a holding member 89 engaged with the hook 826 of the bottom member 829 of each engagement block 82. The holding member 89 may be an elastic ring, a magnet or a spring. In the present embodiment, as shown in FIG. 3A, the holding member is an elastic ring 89. The elastic ring 89 is formed of an elastic material containing plastic or silicon. In the present embodiment, the hooks 826 of the bottom members 829 of the two engagement blocks 82 are hooked by the elastic ring 89. In another embodiment, as shown in FIG. 3B, the elastic ring 89' has two ear rings 891 formed on both sides of the elastic ring 89', Thereby, the hooks 826 of the bottom members 829 of the two engagement blocks 82 are hooked by the ear rings 891 of the elastic ring 89'. Alternatively, a spring may be used to connect the hooks 826 of the bottom members 829 of the two engagement blocks 82. In addition, a magnetic force may be used to force the two engagement blocks 82 to be in the normal state.

As noted above, other types of engagement blocks may be used for the transmitters described herein. For example, the engagement claw 820 does not have to be biased relative to the axial direction and may be a protrusion extending in the axial direction. The engagement claw may have any shape as long as it is engaged with the drive member of the image forming apparatus. In another embodiment, the elastic rings discussed above may be substituted by a tensioning device that is part of the engagement blocks. For example, the pins on which the blocks rotate may have an entirely elastic member such as a spring by which the block 82 is biased such that the engagement claws 820 returns to an upright position. In another embodiment, no elastic ring is provided, and instead, the bottom member 829 of each engagement block 82 protrudes upwards from the notched receptacle 811 such that the drive member of an image forming apparatus contacts the bottom member 829 of each engagement block 82 to return the engagement claws 820 to an upright position.

An assembly process of the transmitter 20 is very simple. As shown in FIG. 6A to FIG. 6F, FIGS. 9A to 9C and 10A to 10F, the two engagement blocks 82 are received in the notched receptacle 811 and pivotally secured to the base 81 by two pins 83. For example, as shown in FIG. 6A to FIG. 6F, the engagement blocks 82 are placed into their respective openings 811*a* and groove 811*b*, the pins 83 are inserted through the through holes 827 of the engagement blocks 82 and the holes 812 of the base 81, respectively, to pivotally attach the engagement blocks 82 to the base 81, whereby the holding member (elastic ring) 89 are placed and hooked on the hooks 826 of the two engagement blocks 82.

Alternatively, as shown in FIG. 9A to FIG. 9C and FIG. 10A to FIG. 10F, first, the shaft 70 is inserted in the elastic ring 89' to position the ear rings 891 in the grooves 811*b*. Then, the engagement blocks are placed into their respective openings 811*a* and grooves 811*b*, the hooks 826 of the two engagement blocks 82 are inserted into the ear rings 891 of the elastic ring 89', and the pins 83 pass through the through holes 827 of the engagement blocks 82 and the boles 812 of the base 81 to pivotally attach the engagement blocks 82 to the base 81.

Figure 6A:
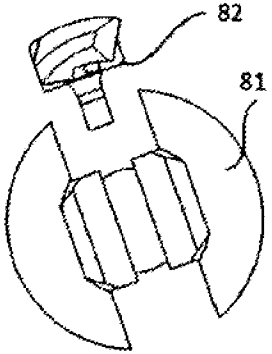
FIG. 6A to FIG. 6F are views showing an assembly process of one embodiment of a transmitter used in a transmission device.
Figure 6B:
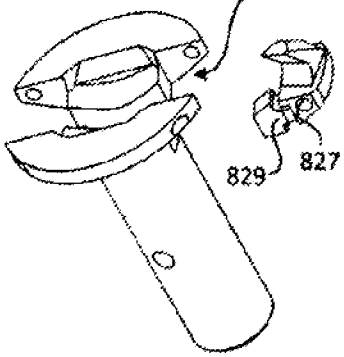
Figure 6C:
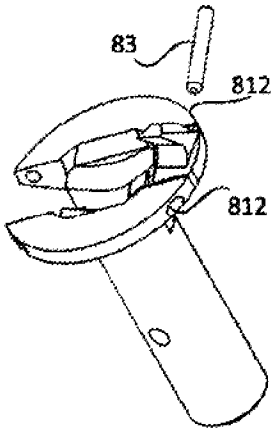
Figure 6D:
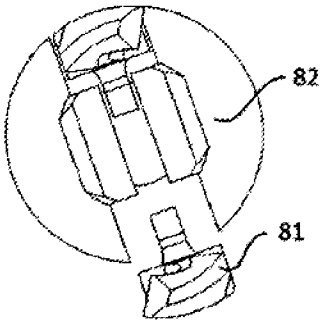
Figure 6E:
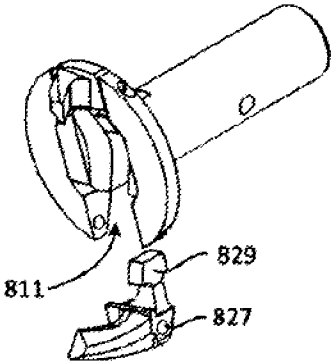
Figure 6F:
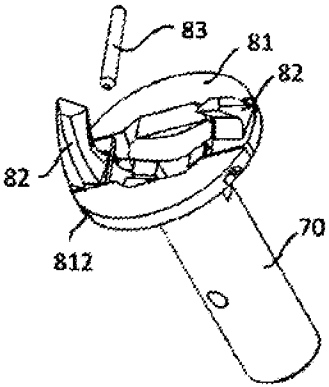
Figure 19A:
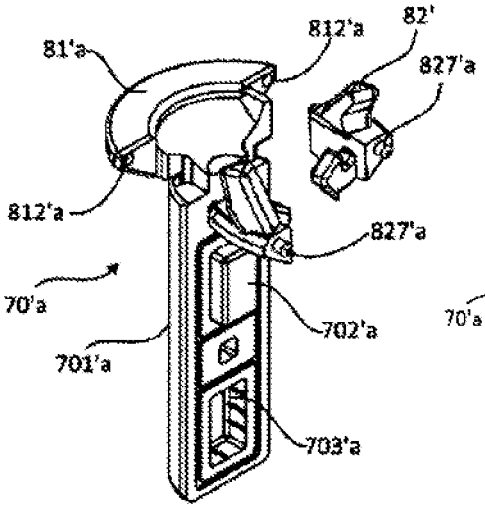
Figure 19B:
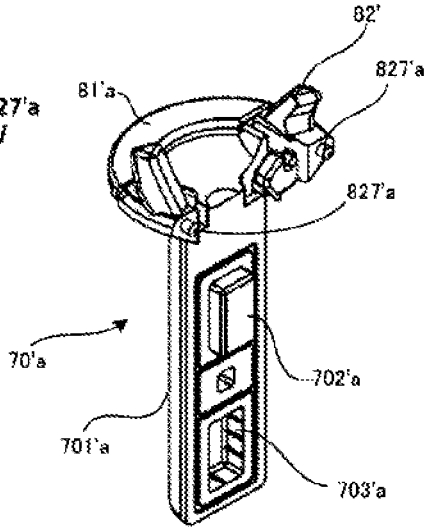
Figure 19C:
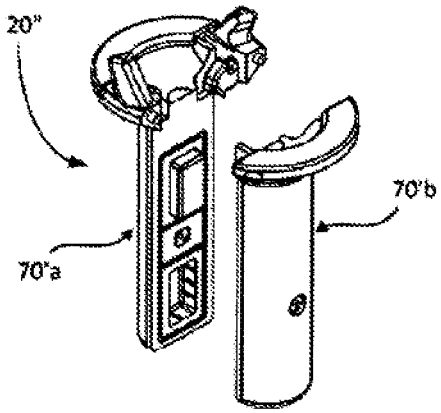
Figure 19D:
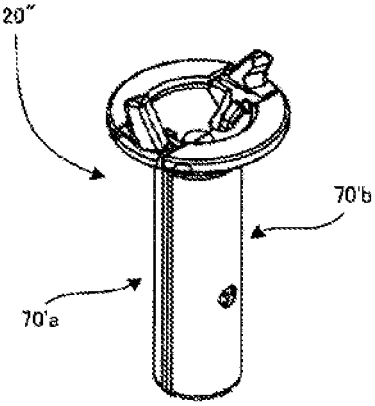
Figure 20A:
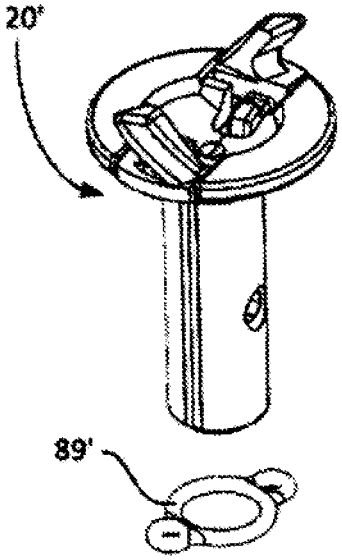
FIG. 20A to FIG. 20D are views showing one embodiment of an assembly process of a transmitter and a holding member.
Figure 20B:
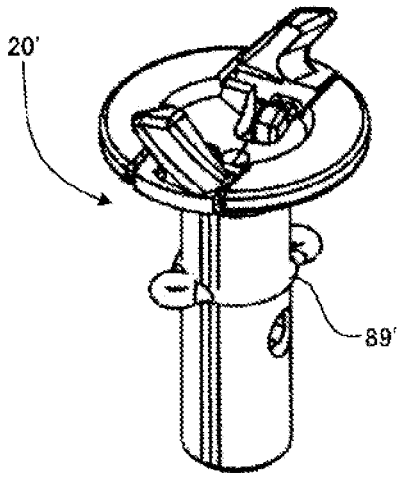
Figure 20C:
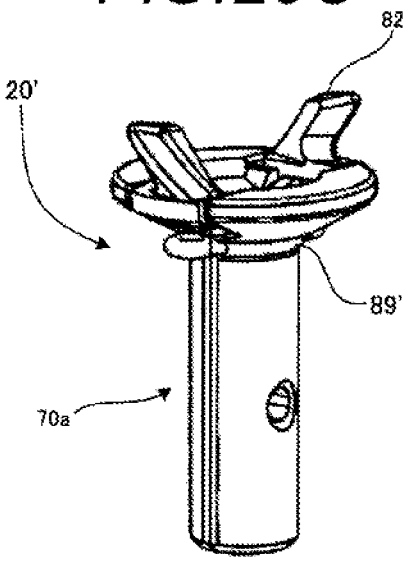
Figure 20D:
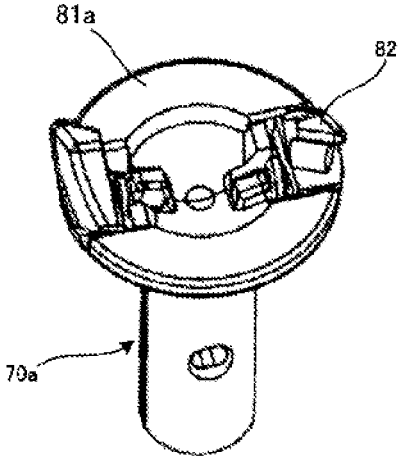

Thereby, the second end portions 829*b* of the bottom members 829 of the engagement blocks 82 are received in their respective openings 811*a*, the first end portions 829*a* of the bottom members 829 of the engagement blocks 82 are received in their respective grooves 811*b*, and the engagement blocks 82 are rotatable around their pivotal axes, for example, their corresponding pins 83. The engagement blocks 82 extend helically from both sides, which are about the upside and the downside of the base 81 of FIG. 2A and FIG. 2B, respectively, in the first direction D1 so as to be away from the drum axis L. By the pulling force acting on the hooks 826 of the two engagement blocks 82 by the elastic ring 89 (or 89') as shown in FIG. 6F and FIG. 19F, the engagement blocks 82 are positioned with their respective engagement claws 820 in an upright position in the normal state.

The transmission devices 100 and 200 comprising the transmitter 20 further includes the intermediate member 30, the gear member (shell) 60 and the elastic member 50.

Referring to FIG. 2A, FIG. 2B, FIG. 11A to FIG. 11C, FIG. 12A and FIG. 12B, particularly, to FIG. 11A to FIG. 11C, FIG. 12A and FIG. 12B, the intermediate member 30 includes a body 32, an axial hole 322 passing through the body 32 along the drum axis L, two guiding grooves 324 formed on the body 32 and communicating with the axial hole 322, and two pillars 34 protruding from the body 32. Only one of the guiding grooves 324 is shown in the figures, and the other groove 324 is located opposite to the groove 324 shown in the figures.

Figure 11A:
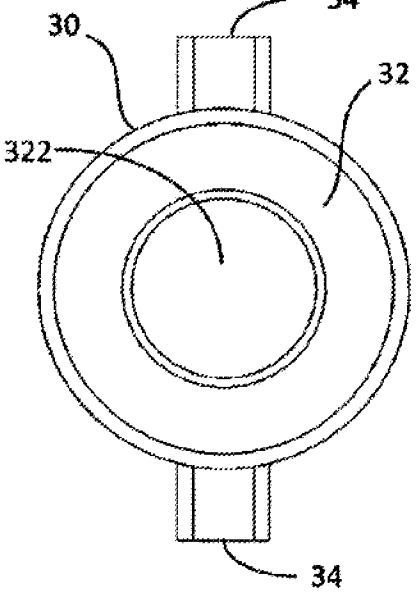
FIG. 11A to FIG. 11C are views showing one embodiment of an intermediate member used in a transmission device for a photosensitive drum.
Figure 11B:
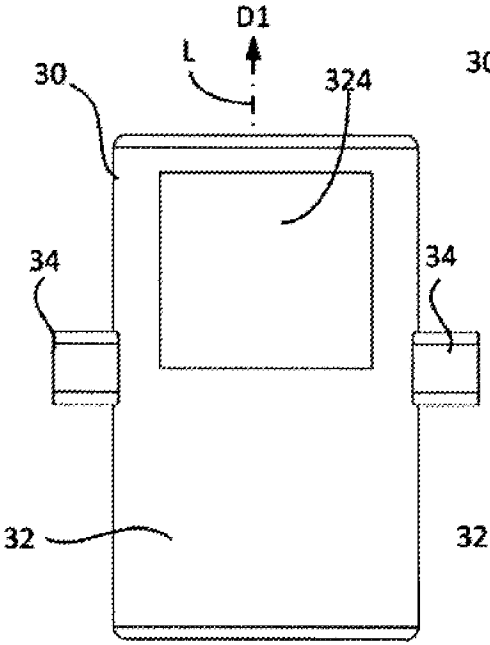
Figure 11C:
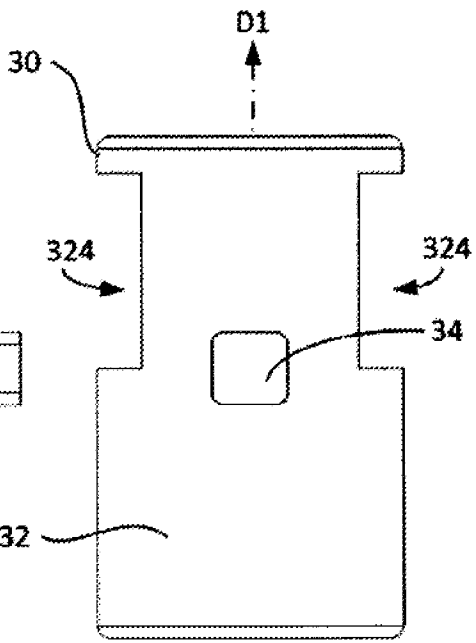

In the embodiment shown in FIG. 11A to FIG. 11C, the guiding grooves 324 are each in the shape of a rectangle, and the bottom side thereof is substantially perpendicular to the drum axis L. The two lateral sides extend toward the first direction D1 from the ends of the bottom side, respectively, and the top side connects with the two lateral sides and is parallel to the bottom side. In the embodiment shown in FIG. 12A and FIG. 12B, the top side has a sloped portion and a portion extending parallel to the bottom side. It should be appreciated to one skilled in the art that other types of grooves may also be used to practice the present invention. For example, as another example of the intermediate member, the intermediate member may be a guiding groove having a shape different from that shown in FIGS. 11A to 11C, 12A and 12B, for example, a triangle, an oval, a circle or a square as long as the shape is such that the pin 40 can move within the guiding groove to allow the transmitter 20 to move in the axial direction and to rotate. When the transmitter 20 is driven by the drive member of the image forming apparatus, the pin 40 contacts an end of the guiding groove 324 of the intermediate member 30 to transmit the rotation to the gear member 60 by the intermediate member 30.

As assembled, the shaft 70 of the transmitter 20 is disposed in the axial bole 322, and is capable of rotating about the drum axis L relative to the intermediate member 30 and moving, along the drum axis L relative to the intermediate member 30. The pin 40 is inserted into the opening 73 of the transmitter 20 in such a way that the shaft 70 of the transmitter 20 has two protrusions 75 extending along the radial direction of the shaft 70. The protrusions 75 are formed of two parts of the pin 40 that protrude out of the opening 73, and are movably received in the guiding grooves 324, respectively.

It should be appreciated to one skilled in the art that the opening 73 of the transmitter 20 may also be provided without penetrating the shaft 70. For example, a structure may be adopted in which the shaft 70 of the transmitter 20 has only one protrusion 75 and the intermediate member 30 has only one guiding move 324. Moreover, the protrusion 75 of the shaft 70 is not limited so as to be formed of the pin 40 inserted in the opening 73. For example, the protrusion 75 may be formed integrally with the shaft body. In that case, the guiding groove 324 has an opening so that the protrusion 75 can enter the guiding groove through the opening. The guiding groove 324 is closed by an annular cap provided to the shaft 70 or the like.

Referring to FIG. 2A, FIG. 2B and FIG. 13A to FIG. 13D, the gear member 60 is adapted for engaging with the photosensitive drum, and the gear member 60 has a top portion 66, a gear portion 67 extending in the second direction D2 from the top portion 66 along the drum axis L, a bottom portion 68 extending in the second direction D2 from the gear portion 67 along the drum axis L, a top wall 64 provided on the side of the top portion 66, and a bottom wall 65 provided on the side of the bottom portion 68. Moreover, the top portion 66 of the gear member 60 may have at least one slot 69. The peripheral configuration of the gear member 60 is similar to the conventional ones. Inside the gear member 60, a housing 62 for receiving the body 32 of the intermediate member 30 is provided along the drum axis L. Thereby, the intermediate member 30 is coupled with the gear member 60 so as not to be rotatable about the drum axis L. In some embodiments, the intermediate member 30 is molded in the gear member 60.

In some embodiments, the gear member 60 has an installation slot provided on the top wall 64 and two control recesses communicating with each other. The housing 61 extends along the drum axis L and is opened on the top wall 64. The installation slot extends from the housing 61 toward the radial direction on both sides of the housing 61 and is opened on the top wall 64. The control recesses, which are located adjacent to the installation slot, extend parallel to the drum axis L and is not opened on the top wall 64. The intermediate member 30 may further have two pillars 34 protruding from the body 32. In assembly, the two pillars 34 of the intermediate member 30 are inserted into the housing 61 through the installation slot, whereby the intermediate member 30 is turned around such that the intermediate member 30 is accommodated in the gear member 60 by the pillars 34 entering the control recesses. Details of these embodiments are disclosed in Patent Literature 5 to Patent Literature 7 and are not repeated herein.

Figure 16A:
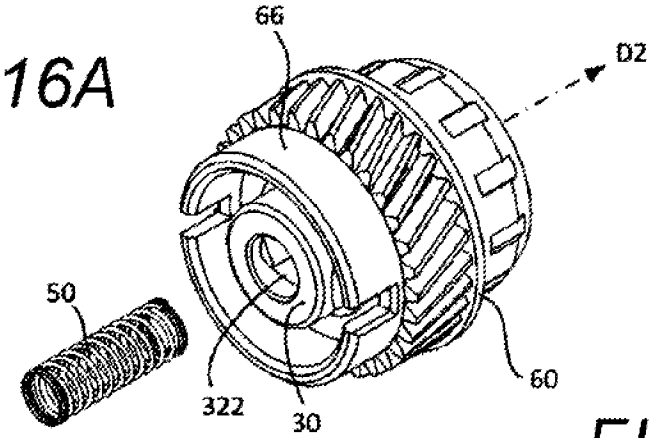
FIG. 16A to FIG. 16C are views showing one embodiment of an assembly process of a transmission device.
Figure 16C:
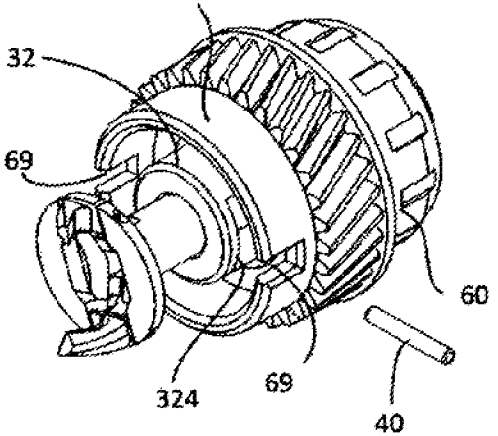
Figure 16B:
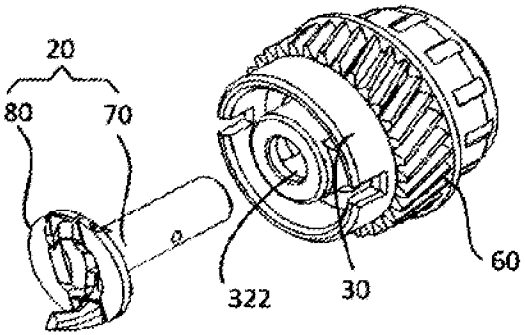

An assembly process of the transmission device is very simple. As shown in FIG. 16A, first, the elastic member 50 is disposed in the axial hole 322 of the intermediate member 30. The axial hole 322 of the intermediate member 30 is in communication with the housing 61 of the gear member 60. Then, as shown in FIG. 16B, the shaft 70 of the transmitter 20 is inserted in the axial hole 322 of the intermediate member 30. Then, as shown in FIG. 16C, the pin 40 is inserted into the opening 73 of the shaft 70 of the transmitter 20 through the through slots 69 of the gear member 60 and the guiding grooves 324 of the intermediate member 30. Thereby, the two end portions (for example, protrusions 75) of the pin 40 are retained in the guiding grooves 324 to be movably limited, and two ends of the elastic member 50 adjoin the bottom wall 65 of the gear member and the second end 72 of the shaft 70 of the transmitter 20, respectively, so that a force generated by the elastic member 50 acts on the second end 72 of the shaft 70 of the transmitter 20 along the drum axis L. Thereby, the pin 40 (for example, protrusions 75) of the shaft 70 is disposed in a position aligned to the top side or the vertex of the guiding grooves 324 of the intermediate member 30 in a normal state of the transmission device.

Figure 17:
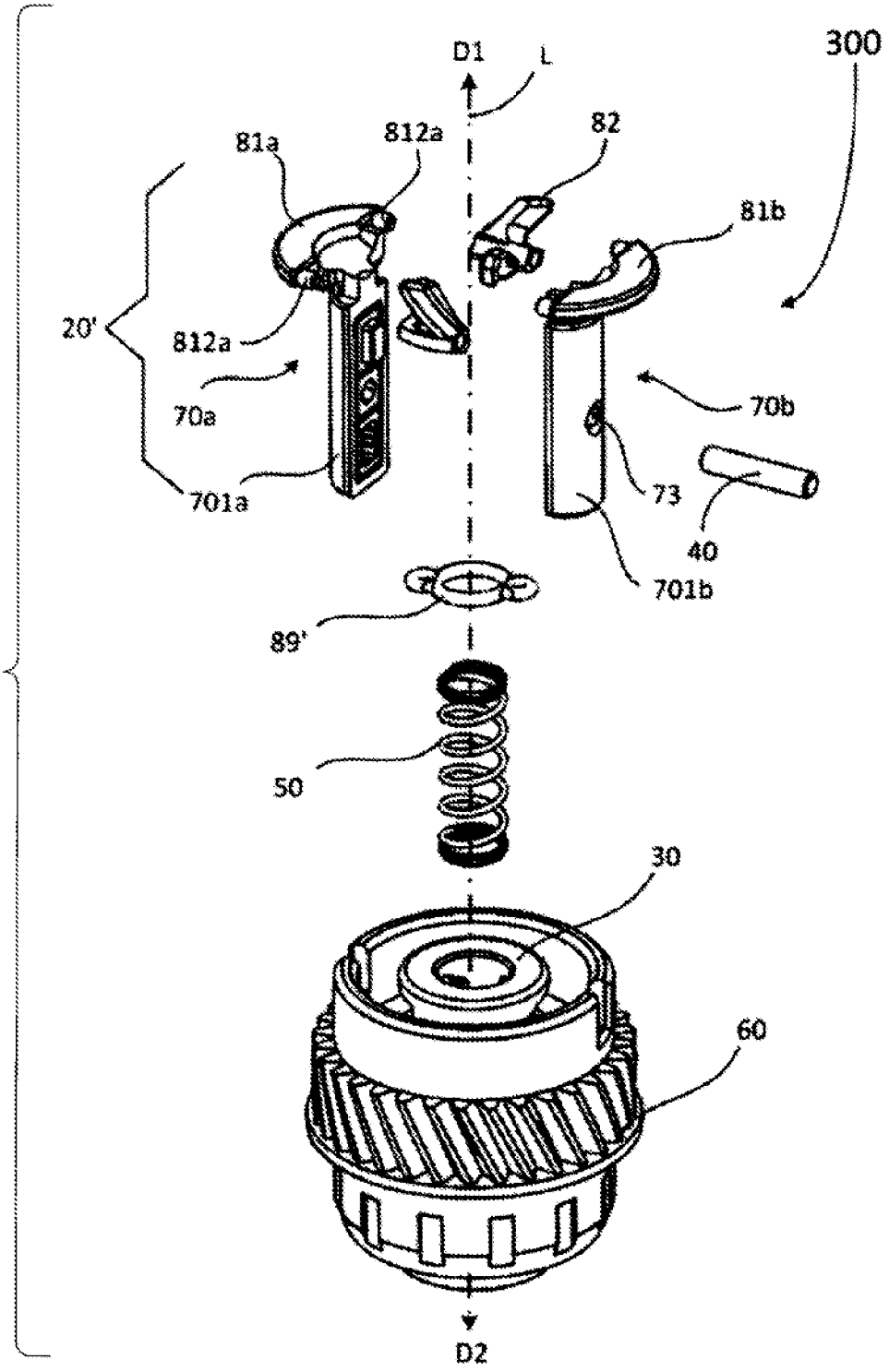
FIG. 17 is an exploded perspective view showing one embodiment of a transmission device.
Figure 18A:
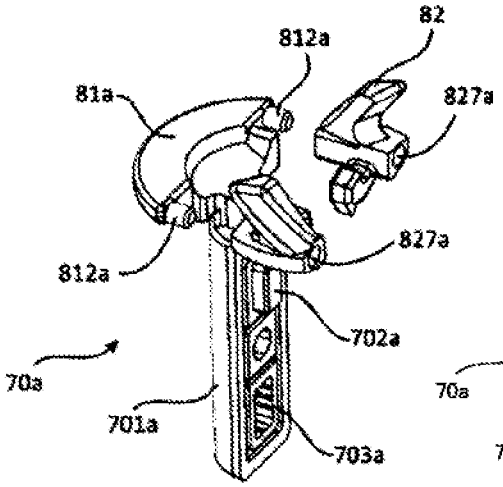
FIG. 18A to FIG. 18D are exploded perspective views showing one embodiment of a transmitter and its assembly process.
Figure 18B:
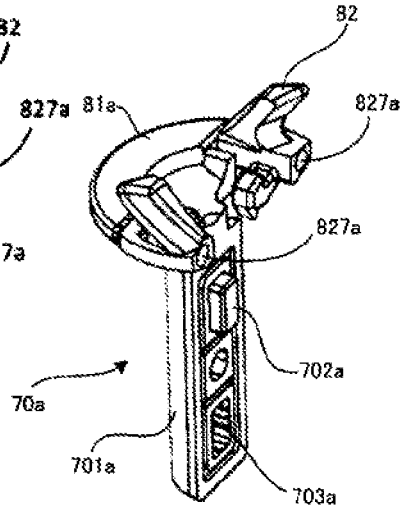
Figure 18C:
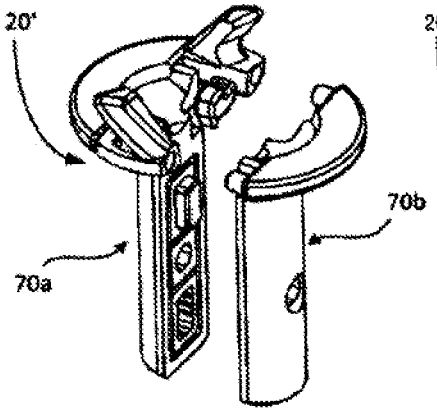
Figure 18D:
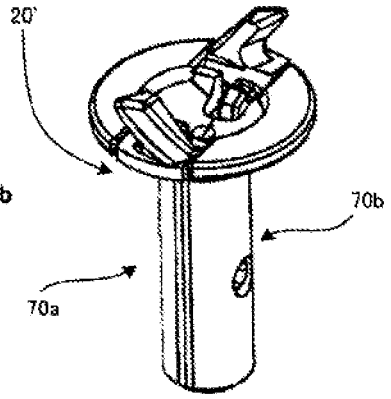

FIG. 17 shows one embodiment of a transmission device 300. While the transmission device 300 is essentially the same as the transmission device 200 shown in FIG. 2B, a transmitter 20' used in the transmission device 300 is different from the transmitter (20) of the transmission device 200. FIG. 18A to FIG. 18D show the transmitter 20' of the present embodiment that includes the shaft, the base and the two engagement blocks.

Referring to FIG. 17 and FIG. 18A to FIG. 18D, the shaft 70 in the present embodiment includes a first part 70*a* and a second part 70*b*. The first part 70*a* includes a semi-cylindrical body 701*a*, and the second part 70*b* includes a semi-cylindrical body 701*b*. The base 81 also has base portions 81*a* and 81*b* which are two parts, and these extend from one ends of the semi-cylindrical bodies 701*a* and 701*b*, respectively. The semi-cylindrical bodies 701*a* and 701*b* of the first part 70*a* and the second part 70*b* are detachably attachable to each other.

In the present embodiment, the semi-cylindrical bodies 701*a* and 701*b* each have an elongated plane surface parallel to the drum axis L, at least one protrusion 702*a* protruding from the elongated plane surface, and at least one recess 703*a* recessed from the elongated plane surface. Thereby, when assembled, the at least one protrusion 702*a* of the semi-cylindrical body 701*a* of the first part 70*a* is received in the at least one recess 703*b* of the semi-cylindrical body 701*b* of the second part 70*b*, and the at least one protrusion 702*b* of the semi-cylindrical body 701*b* of the second part 70*b* is received in the at least one recess 703*a* of the semi-cylindrical body 701*a* of the first part 70*a*. That is, the semi-cylindrical bodies 701*a* and 701*b* of the first part 70*a* and the second part 70*b* of the shaft 70 are detachably snapped to each other.

In another embodiment, protrusions and recesses of different shapes (for example, circular, triangular, etc.) and/or a different number of protrusions and recesses (one of each, three of each, etc.) are used, and detachably attached to the semi-cylindrical bodies 701*a* and 701*b* of the fit part 70*a* and the second part 70*b* of the shaft 70 by a snap-fit structure. Alternatively, the protrusions and recesses may be sized to be detachably coupled to the semi-cylindrical bodies 701*a* and 701*b* by a fiction-fit structure.

In this embodiment, the base 81 has two base portions 81*a* and 81*b*. The base portions 81*a* and 81*b* have two pins 812*a* extending toward the at least two notched receptacles 811, respectively, and as assembled, each pin 812*a* is coincident with the pivotal axis.

While in the present embodiment, each engagement block 82 is essentially the same as that shown in FIG. FIG. 8A to FIG. 8D, two holes 827*a* are provided on both sides of the bottom member instead of a through hole. Thereby, when assembled, the pins 812*a* of the base portions 81*a* and 81*b* are received in the two holes 827*a* of the engagement blocks 82. Accordingly, each engagement block 82 is rotatable around the pivotal axis at the second end portion 829*b* of the bottom member 829.

FIG. 19A to FIG. 19D shows a transmitter 20" as another embodiment. While the transmitter 20" is essentially the same as the transmitter 20' of FIG. 18A to FIG. 18D, the base portions and engagement blocks used in the transmitter 20" are different from those of the transmitter 20'. In the present embodiment, the base portions 81'*a* and 81'*b* each have two holes 812'*a* facing the at least two notched receptacles 811, respectively, and as assembled, each hole 812'*a* is coincident with the pivotal axis. Moreover, each engagement block 82' has two pins 827'*a* protruding in the opposite direction from its bottom member. Thereby, when assembled, the two pins 827'*a* of each engagement block 82' are received in the corresponding holes 812'*a* of the base portions 81'*a* and 81'*b*. Accordingly, each engagement block 82' is rotatable around the pivotal axis.

Figure 9A:
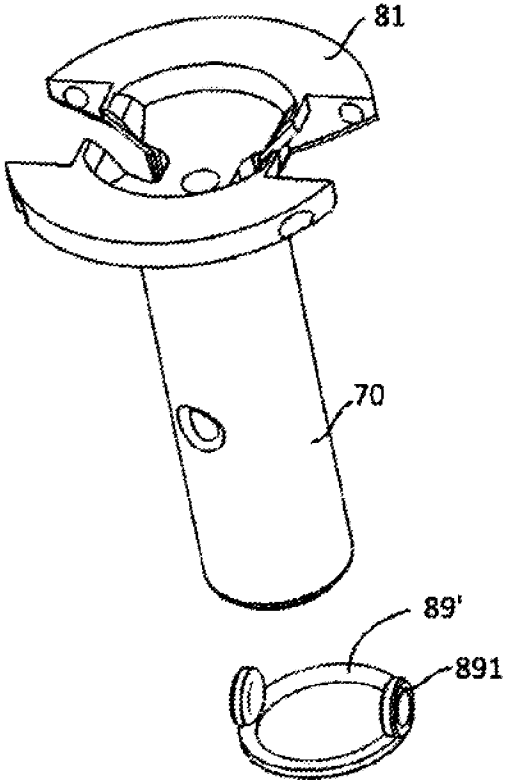
FIG. 9A to FIG. 9C are views showing one embodiment of an assembly process of a transmitter used in a transmission device.
Figure 9B:
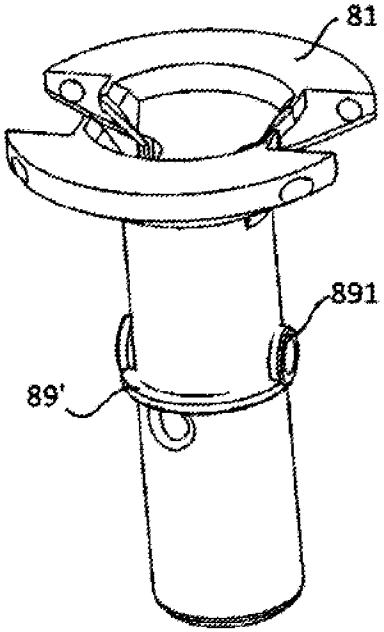
Figure 9C:
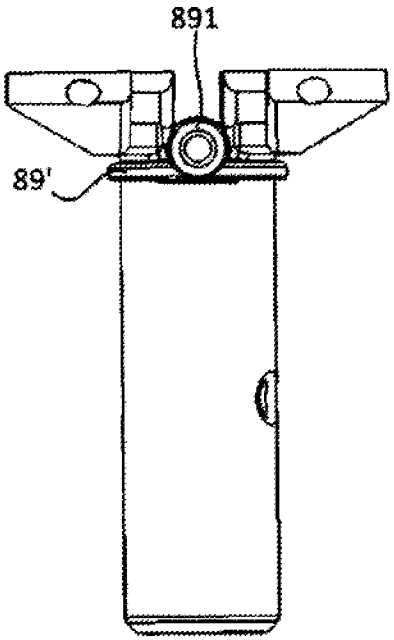
Figure 10A:
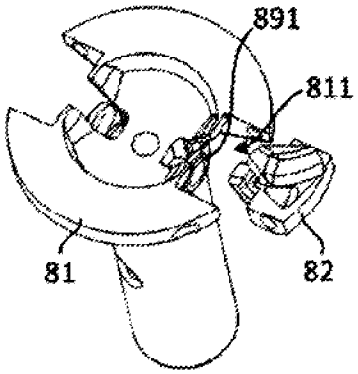
FIG. 10A to FIG. 10F are views showing one embodiment of the assembly process of the transmitter used in the transmission device.
Figure 10B:
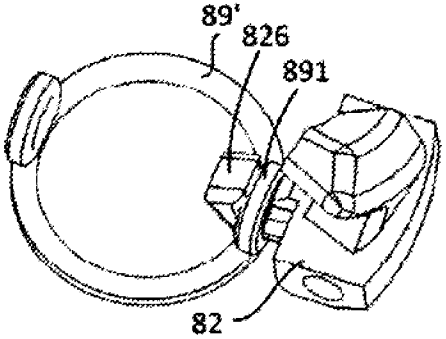
Figure 10C:
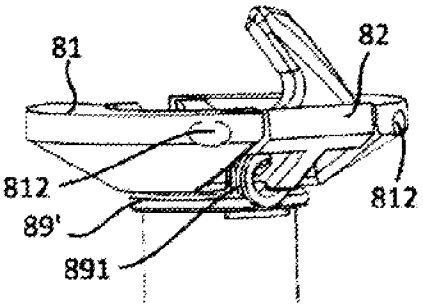
Figure 10D:
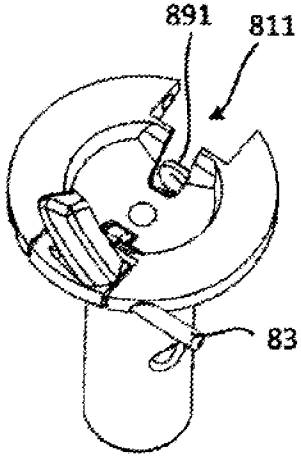
Figure 10E:
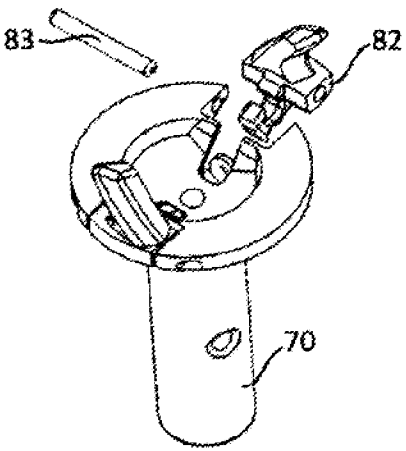
Figure 10F:
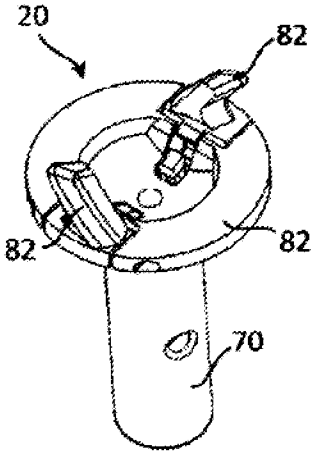

FIG. 20A to FIG. 20D show a process of assembly of the transmitter 20' (or 20") to a holding member 89' according to an embodiment the same as that of FIG. 9A to 9C. In the present embodiment, the elastic ring 89' includes two ear rings formed on both sides of the elastic ring 89'. For this reason, the hooks 826 of the bottom members 829 of the two engagement blocks 82 are hooked by the ear rings 891 of the elastic ring 89'. Alternatively, a spring may be used to connect the hooks 826 of the bottom members 829 of the two engagement blocks 82.

The transmitters 20, 20' and 20" discussed above each have two engagement blocks 82. In another embodiment, the number of engagement blocks is not necessarily two (for example, one, three, four, etc.).

Figure 21A:
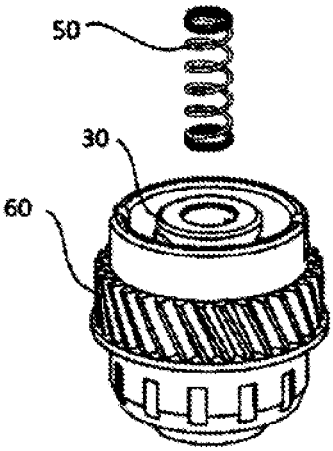
FIG. 21A to FIG. 21D are views showing one embodiment of an assembly process of a transmission device.
Figure 21B:
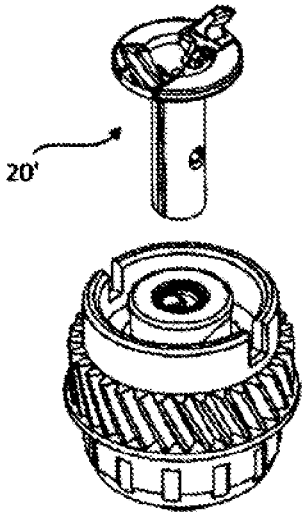
Figure 21C:
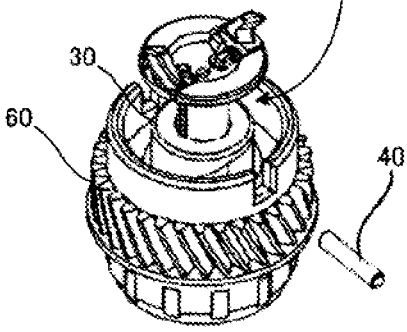
Figure 21D:
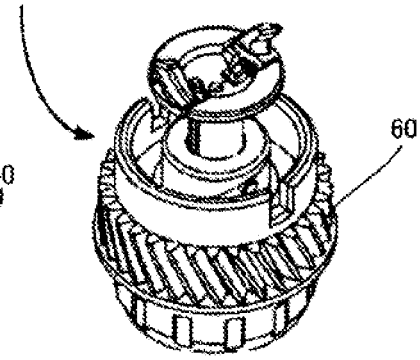
Figure 23A:
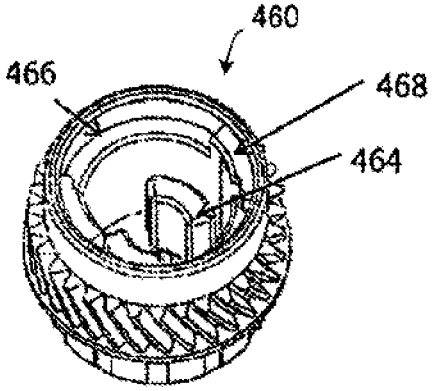
FIG. 23A to FIG. 23D are views showing one embodiment of a gear member used in a transmission device.
Figure 23B:
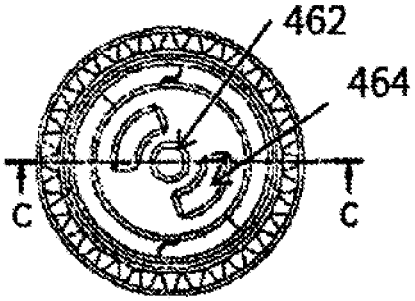
Figure 23C:
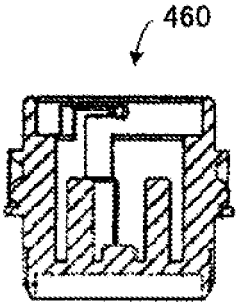
Figure 23D:
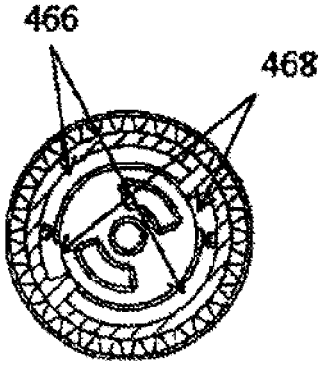

FIG. 21A to FIG. 21D show an assembly process of the transmission device 300. This process is the same as that of the transmission device 100 of FIG. 16A to FIG. 16B. At first, as shown in FIG. 21A, the elastic member 50 is disposed in the axial hole of the intermediate member 30. The axial hole of the intermediate member 30 is in communication with the housing of the gear member (shell) 60. Then, as shown in FIG. 21B, the shaft of the transmitter 20' is inserted into the axial hole of the intermediate member 30. Then, as shown in FIG. 21C, the pin 40 is inserted into the opening of the shaft of the transmitter 20' through the through slots of the gear member 60 and the guiding grooves of the intermediate member 30. Thereby, the two end portions (for example, protrusions) of the pin 40 are retained and movably accommodated in the guiding grooves, and two ends of the elastic member 50 adjoin the bottom wall of the gear member 60 and the second end of the shaft of the transmitter 20', so that a force generated by the elastic member 50 acts at the second end of the shaft of the transmitter 20' along the drum axis L. Thereby, the pin 40 (for example, protrusions) of the shaft is situated on the upper side or at the vertex of the guiding grooves of the intermediate member 30 in a normal state of the transmission device 300.

In another embodiment, a protrusion 75 that is integral with the semi-cylindrical bodies 701*a* and 701*b* and extends therefrom is used instead of the pin 40. Such a protrusion 75 may be formed together with the semi-cylindrical bodies 701*a* and 701*b*.

FIG. 22A to FIG. 22C show a transmission device 400 as another embodiment. The transmission device 400 has a gear member (shell) 460, an intermediate member 430, and a transmitter 420. These members are the same as those of the embodiments described above except what will be described below.

As can be seen in FIG. 23A to FIG. 23D, the gear member 460 includes a central projection 462 extending axially upward from a bottom wall of the gear remember 460 and at least one peripheral projection 464 positioned radially outside of the central projection 462. In the embodiment shown in FIG. 23A to FIG. 23D, two peripheral projections 464 are provided. However, the number of peripheral projections 464 may be one, or three or more may be provided.

The gear member 460 further includes, on its inside surface, an inner wall ledge 466 and at least one receiving member 468 on or adjacent to the inner wall ledge 466. A structure may be adopted in which the inner wall ledge 466 extends continuously around the inside surface of the gear member 460 and the at least one receiving members 468 are provided on the inner wall ledge 466. Alternatively, a structure may be adopted in which the inner wall ledge 466 includes one or more pieces that do not extend continuously around the inside surface of the gear member 460 and the at least one receiving member 468 is disposed adjacent to the pieces of the inner wall ledge 466.

As shown in FIG. 24A to FIG. 24D, the intermediate member 430 includes a cylindrical body 432. From the cylindrical body 432, one or more protrusions 434 extend radially outward. The intermediate member 430 also includes an introducing groove 436 on its top face. In one embodiment, the introducing groove is sized such that the protrusion in the shaft 70 of the transmitter 420 can pass through the introducing groove 436. Thus, instead of the separate pin 40, a protrusion integrated with the transmitter such as a molded part of the shaft may be used together with the intermediate member. In another embodiment, the introducing groove is smaller than the protrusion and thus the protrusion must be inserted into the shaft of the transmitter after the shaft is positioned within the intermediate member.

Figures 24A, 24B:
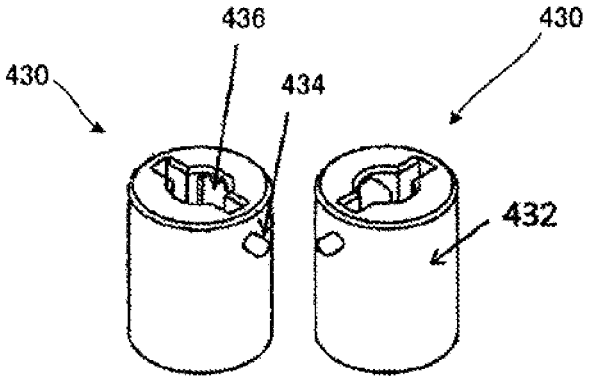
FIG. 24A to FIG. 24D are views showing one embodiment of an intermediate member used in a transmission device.
Figures 24C, 24D:
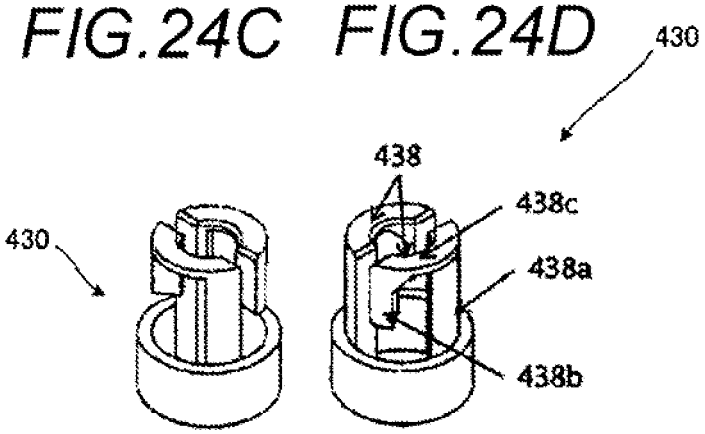

FIG. 24C and FIG. 24D show the intermediate member 430 together with part of the cylindrical body 432 and the top face removed to expose transmitter retention members 438 of the intermediate member 430. The illustrated embodiment of the intermediate member 430 includes two retention members (transmitter retention members) 438 that are identical to each other and extend axially upward from the bottom of the intermediate member 430. Alternatively, the retention members 438 may be formed on or attached to the inside surface of the cylindrical body 432 such that they extend radially inward toward the center of the intermediate member 430.

The retention members 438 each include two axial baffles 438*a* and 438*b* having their tops connected by a connecting piece 438*c*. The axial baffle 438*a* extends toward the bottom face of the cylindrical body 432 further than the axial baffle 438*b*. The retention members 438 are disposed apart from each other so that a gap is provided.

A process of assembling the transmitter 420 to the intermediate member 430 will be described with reference to FIG. 25A to FIG. 25C showing the whole of the intermediate member 430 and the cylindrical body 432 and FIG. 26A to FIG. 26C showing the intermediate member 430 and the cylindrical body 432 which is partly removed. The transmitter 420 is similar to the above-described transmitter 20' formed of two members. However, a different transmitter may be used together with the intermediate member 430 and the gear member 60. For example, the number and shape of the engagement blocks 82 may be changed as described in the present application.

The shaft 70 of the transmitter 420 is aligned with and inserted axially into the introducing groove 436 in the top face of the intermediate member 430 such that the pin 40 passes through the introducing groove 436. Since the transmitter 420 is moved further into the intermediate member 430 in the axial direction, the pin 40 is flipped up by the axial baffles 438*a* and 438*b* of each retention member 438 so that the transmitter 420 is prevented from rotating with respect to the intermediate member 430 by the baffles 438*a* and 438*b*.

The transmitter 420 gradually moves in the axial direction far enough for the pin 40 to pass the bottom of the shorter axial baffles 438*b*. At this point, the transmitter 420 can rotate with respect to the intermediate member 430. The rotation of the transmitter 420 is counterclockwise in the embodiment of FIG. 25A to FIG. 25C and FIG. 26A to FIG. 26C. However, in one embodiment, the rotation may be clockwise as the positions of the axial baffles 438*a* and 438*b* are reversed.

After the pin 40 rotates past the bottom of the shorter axial baffles 438*b*, the pin 40 enters the area called the guiding groove 324 on the upper side. As shown in FIG. 26D, the guiding groove 324 of the intermediate member 430 is different from that described above in that it is partially open such that the pin is attached to (or integrated with) the transmitter 420 before the transmitter 420 is inserted into the intermediate member 430. Even though the guiding groove 324 is partially open, as described later, the transmitter 420 is biased in the axial direction by an elastic member 50 such as a spring, so that the pin 40 is held in the guiding groove 324.

Figure 12B:
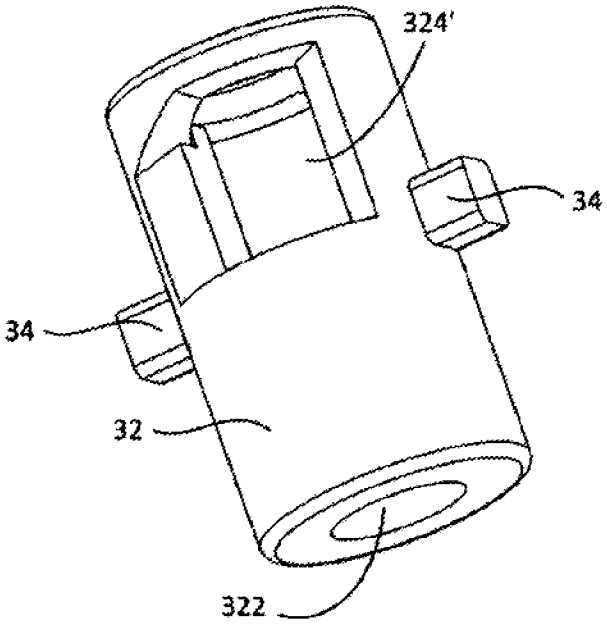
FIG. 12A and FIG. 12B are views showing one embodiment of an intermediate member used in a transmission device for a photosensitive drum.
Figure 12A:
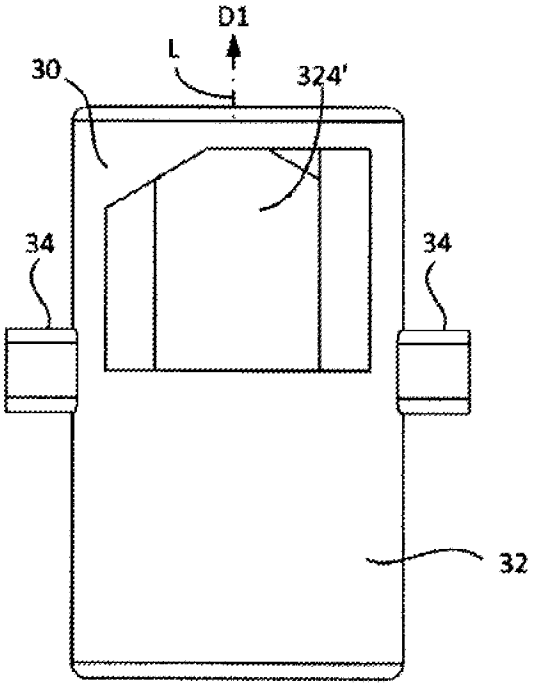
Figure 13A:
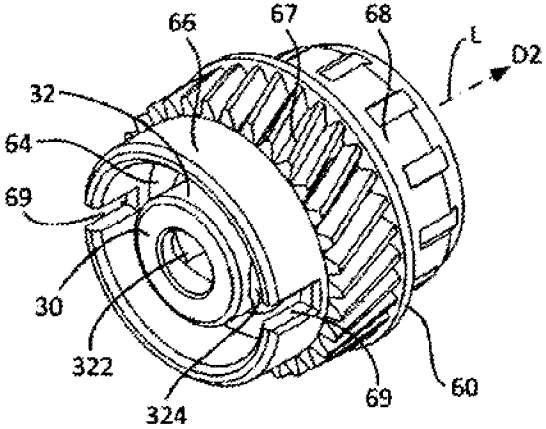
FIG. 13A to FIG. 13D are views showing one embodiment of a gear member and an intermediate member used in a transmission device for a photosensitive drum.
Figure 13B:
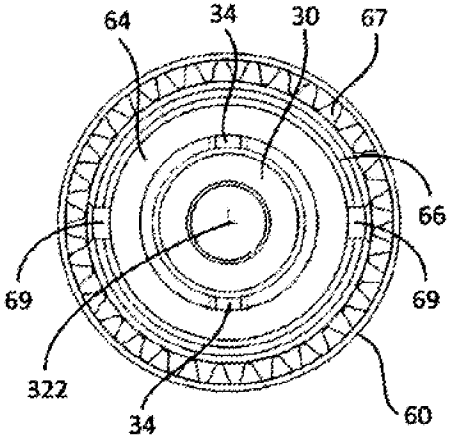
Figure 13C:
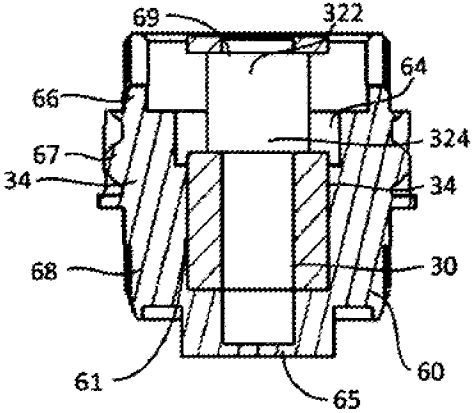
Figure 13D:
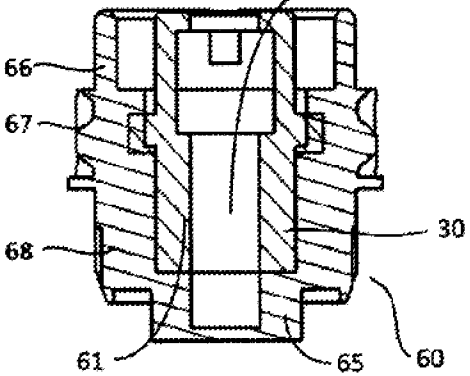
Figure 14:
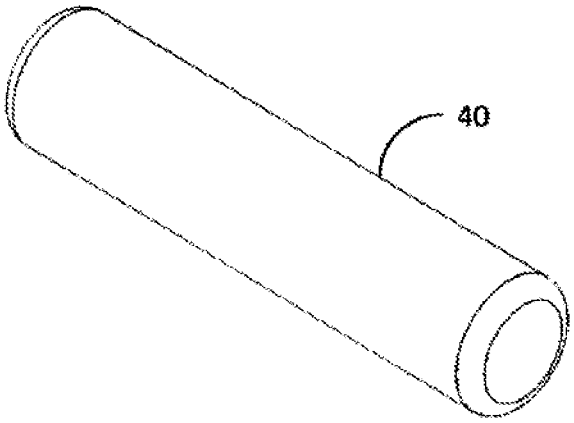
FIG. 14 is a view showing one embodiment of a pin used in a transmission device for a photosensitive drum.
Figure 15:
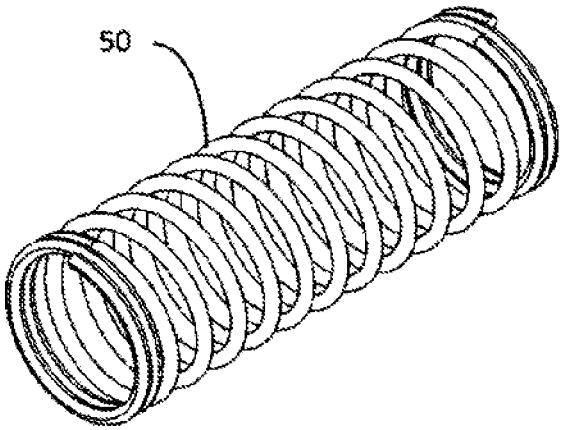
FIG. 15 is a view showing one embodiment of an elastic member used in a transmission device.

As shown in FIG. 26D, the guiding groove 324 formed of each retention member 438 has a shape similar to that of the embodiment shown in FIG. 12A and FIG. 12B. Particularly, the shape of the guiding groove 324 is a rectangle except that the top side has a sloped portion and a portion extending parallel to the bottom side and that the left side has an opening because the shorter axial baffle 438*b* does not extend to the bottom of the rectangle. The guiding groove 324 formed of each retention member 438 may have a different shape such as a rectangle, a square, an oval, a circle or a triangle, provided that it is a shape such that the pin enters the guiding groove 324 and the guiding groove 324 retains the pin 40 while the transmitter 420 is freely moving in the axial direction and rotating.

The process for assembling the intermediate member 430 to the gear member 460 will be described. The intermediate member 430 can be assembled to the gear member 460 together with or separately from the transmitter 420 already assembled to the intermediate member 430. FIG. 27A to FIG. 27C show the state of the intermediate member 430 assembled to the gear member 460 after the transmitter 420 is assembled to the intermediate member 430. While FIG. 27A to FIG. 27C show the assembly process similar to that of FIG. 22A to FIG. 22C, the cylindrical body 432 is partly removed.

The elastic member 50 is inserted into the gear member 460 and held between the central projection 462 and the peripheral projections 464. Then, the intermediate member 430 is inserted axially into the gear member 460 up to the protrusions 434. As can be seen in FIG. 22B, the protrusions 434 extend radially outward from the cylindrical body 432 of the intermediate member 430, and contact the inner wall ledge 466 of the gear member 460. Then, as shown in FIG. 22C, the intermediate member 430 is rotated until the protrusions 434 contact the receiving members 468. The receiving members 468 each include an opening such that the protrusions 434 are snap fit into the openings. This snap fit prevents the protrusions 434 from backing out of the receiving members 468 unless a force sufficient to cancel the snap fit is applied. Moreover, the protrusions 434 may be retained by friction in the openings, or the protrusions may be freely movable without resistance from the openings and protrude out of the openings.

When the protrusions 434 are received by the receiving members 468, the gear member 460 is assembled to the intermediate member 430. As noted above, the transmitter 420 can be assembled to the intermediate member 430 before the intermediate member 430 is assembled to the gear member 460. In this case, since the intermediate member 430 is inserted axially into the gear member 460, the elastic member 50 passes through an opening in the bottom of the intermediate member 430 and contacts the shaft 70 of the transmitter 420 to bias the transmitter 420 away from the bottom of the intermediate member 430. Thereby, the pin 40 in the shaft 70 is biased toward a top side of the guiding groove 324 away from the opening in the guiding groove 324, whereby the pin 40 can be held in the guiding groove 324. Thus, the transmitter 420 remains assembled to the intermediate member 430.

To remove the transmitter 420 from the intermediate member 430, an axial force sufficient to overcome the biasing force by the spring (elastic member) 50 is applied to the transmitter 420 to thereby move the transmitter 420 axially toward the bottom of the intermediate member 430. Then, the transmitter 420 rotates such that the pin 40 passes below the bottom of the shorter axial baffles 438*b*. After the pin 40 passes below the bottom of the axial baffles 438*b*, the transmitter 420 can freely separate from the intermediate member 430 and move out of the introducing groove 436 by moving the transmitter 420 axially away from the bottom of the intermediate member 430 while the pin 40 is passing through the gap between the retention members 438.

In a case where the intermediate member 430 is not assembled to the transmitter 420 until after the intermediate member 430 is assembled with the gear member 460, although the intermediate member 430 is assembled to the transmitter 420 as described above, a biasing force is caused by the spring 50, and the force moves the transmitter 420 axially toward the bottom of the intermediate member 430 and is overcome because the transmitter 420 rotates such that the pin 40 passes below the bottom of the shorter axial baffles 438*b* to enter the guiding groove 324.

Another embodiment of the transmission device is shown as reference character 500 in FIG. 28A to FIG. 32B. The transmission device 500 includes a gear member (shell) 560, an intermediate member 530 and a transmitter 520. While each of these components is as described above for the transmission device 400, differences will be described below.

Figure 31:
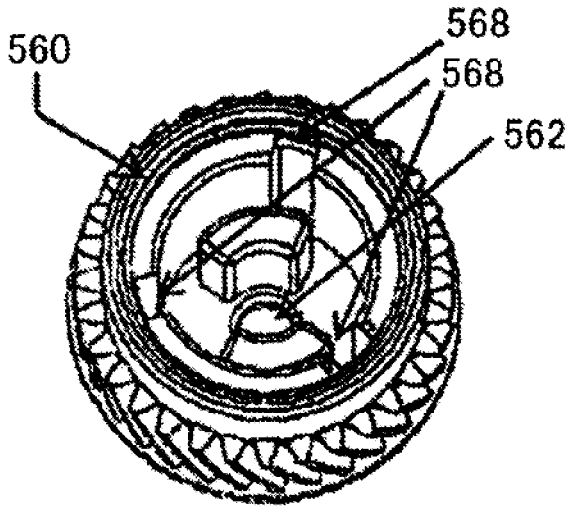
FIG. 31 is a view showing one embodiment of the gear member used in the transmission device.
Figure 32A:
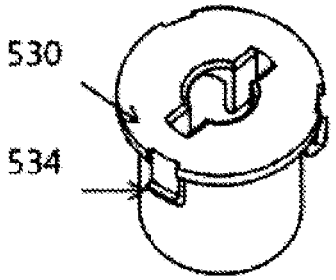
FIG. 32A and FIG. 32B are views showing one embodiment of an intermediate member used in a transmission device.
Figure 32B:
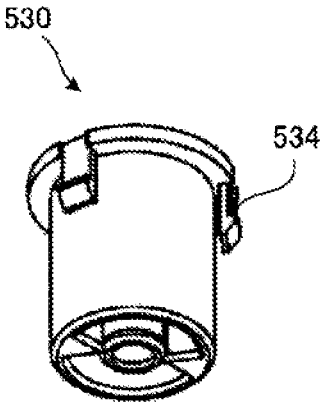

As shown in FIG. 31, the gear member 560 includes a recession 562 that replaces the central projection 462 at the center of its bottom face. Moreover, one or more receiving members 568 are provided instead of the one or more receiving members 468, and as described below in more detail, clips 534 of the intermediate member 530 are received and retained instead of receiving and retaining the protrusions 434 of the intermediate member 430.

The gear member 560 of the embodiment shown in FIG. 31 includes three receiving members 568 that are separated by three inner wall ledges. However, the gear member 560 may have one, two, four, or more receiving members 568.

Preferably the number of receiving members 558 is the same as the number of clips 534 of the intermediate member 530.

Figure 28A:
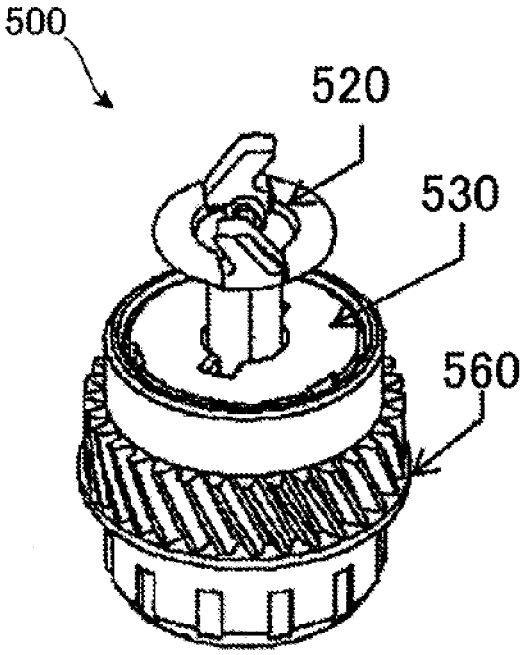
FIG. 28A and FIG. 28B are views showing one embodiment of a transmission device and its assembly process.
Figure 28B:
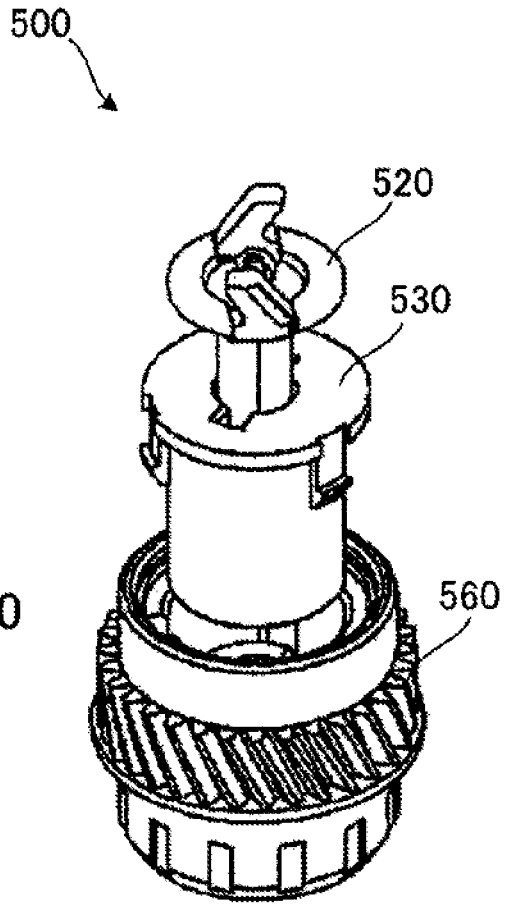
Figure 30:
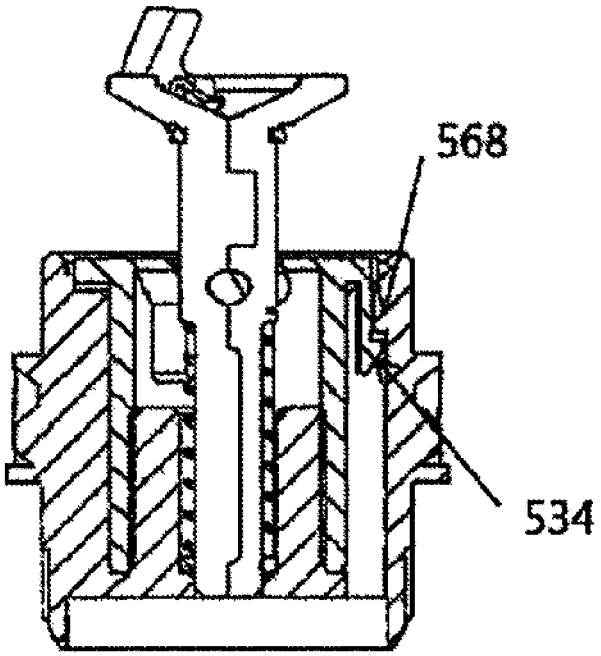
FIG. 30 is a cross-sectional view showing one embodiment of a transmission device.

As noted above, the intermediate member 530 includes the clips 534 that replace the protrusions 434. Thus, as shown in FIG. 28A and FIG. 28B, the intermediate member 530 can be assembled with the gear member 560 by aligning the clips 534 with the receiving members 568 and pressing the intermediate member 530 into the gear member 560 in the axial direction. Initially, the clips 534 contact the receiving members 568 and are deflected radially inwards to allow the intermediate member 530 to continue to be pressed into the gear member 560. When the intermediate member 530 is moved a sufficient distance in the axial direction, the clips 534 pass the receiving members 568 and elastically return to their original position. As shown in FIG. 30, in the assembled position, each clip 534 includes an inner wall ledge. If a user attempts to separate the intermediate member 530 from the gear member 560, the inner wall ledge contacts the receiving member 568, thereby preventing the intermediate member 530 from being removed from the gear member 560. Thus, instead of being inserted axially and rotated, the intermediate member 530 is assembled with the gear member 560 by moving the intermediate member 530 in the axial direction until the clips 534 are aligned with the receiving members 568 and the clips 534 pass the receiving members 568.

In another embodiment, the receiving members are elongated in the axial direction such that, even when the intermediate member 530 is fully inserted into the gear member 560, the clips 534 contact the receiving members 568. Thus, the clips 534 remain deflected and by the fiction generated from the contact between the clips 534, the receiving members 568 hold the intermediate member 530 in the gear member 560.

Figure 29A:
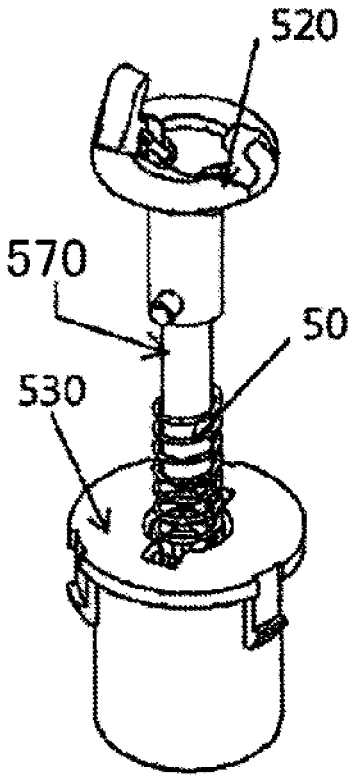
FIG. 29A and FIG. 29B are views showing one embodiment of an assembly process of an intermediate member, and a transmitter of a transmission device.
Figure 29B:
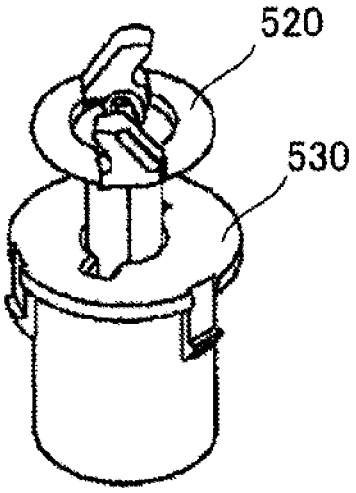

While the transmitter 520 shown in FIG. 29A with the intermediate member 530 and the gear member 560 is similar to the transmitter 420, it is different in that the shaft 70 includes a portion 570 having a reduced diameter. To assemble the intermediate member 530 and the transmitter 520, the elastic member 50 is placed around the reduced diameter portion 570 of the shaft 70. Then, the shaft 70 of the transmitter 520 is inserted into the introducing groove 436 and moved in the axial direction and rotated. Thus, as can be understood from FIG. 29A and FIG. 30, the elastic member 50 is positioned within the intermediate member 530. This elastic member contacts the bottom of the intermediate member 530 to cause a biasing force against the transmitter 520.

When the transmitter 520 is moved in the axial direction, the recession 562 in the gear member 560 provides extra room to allow the shaft 70 to travel in the axial direction. Alternatively, a hole to allow the shaft to pass through the gear member 560 may be provided instead of the recession 562.

Similar to the transmission device 400, the intermediate member 530 can be assembled with the transmitter 520 before or after the intermediate member 530 is assembled with the gear member 560.

In another embodiment of the transmission device 500, as shown in FIG. 33A to FIG. 35C, a gear member 660 may be used instead of the gear member 560, and an intermediate member 630 may be used instead of the intermediate member 530. Except for the differences described below, the gear member 660 is the same as the gear member 560 and the intermediate member 630 is the same as the intermediate member 530.

Figure 33A:
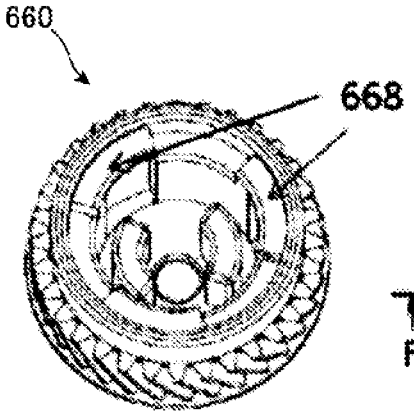
FIG. 33A to FIG. 33C are views showing one embodiment of a gear member used in a transmission device.
Figure 33B:
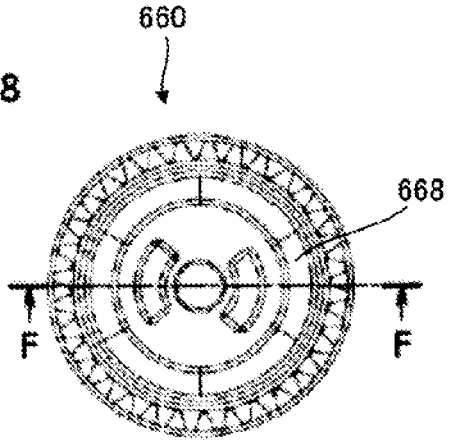
Figure 33C:
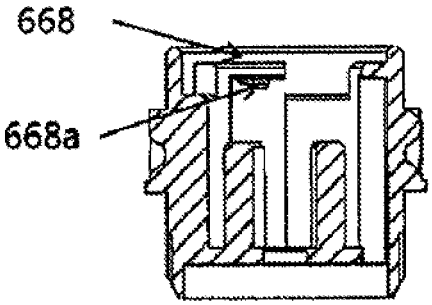

As can be seen in FIG. 33A to FIG. 33C, the gear member 660 includes receiving members 668 that replace the receiving members 568 described above. Each receiving member 668 has a projection 668*a* extending from the bottom face of the receiving member 668.

Figure 34A:
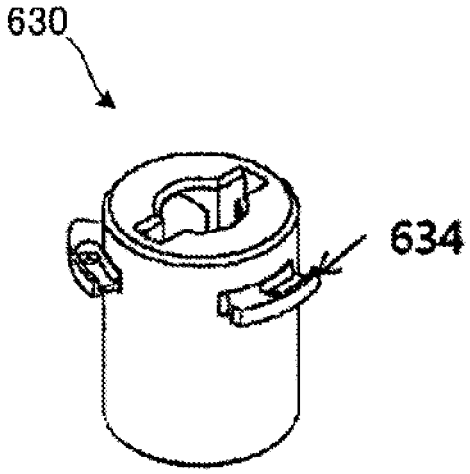
FIG. 34A and FIG. 34B are views showing one embodiment of an intermediate member used in a transmission device.
Figure 34B:
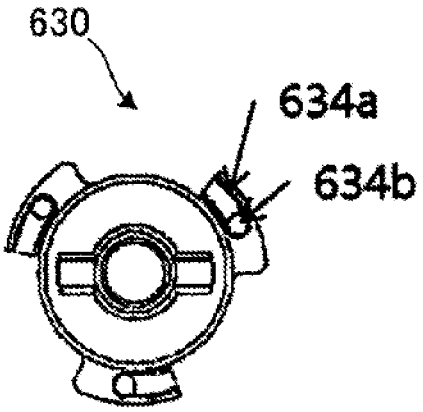

As can be seen in FIG. 34A and FIG. 34B, the intermediate member 630 includes protrusions 634 extending radially outward from the cylindrical body. Each protrusion 634 includes a groove 634*a* that is recessed from the top face of the protrusion. The groove 634*a* extends from one edge of the protrusion 634 and terminates in a depression 634*b* that is recessed further from the top face of the protrusion 634 than the groove. Moreover, a through hole may be used instead of the depression 634*b*.

Figures 35A, 35B, 35C:
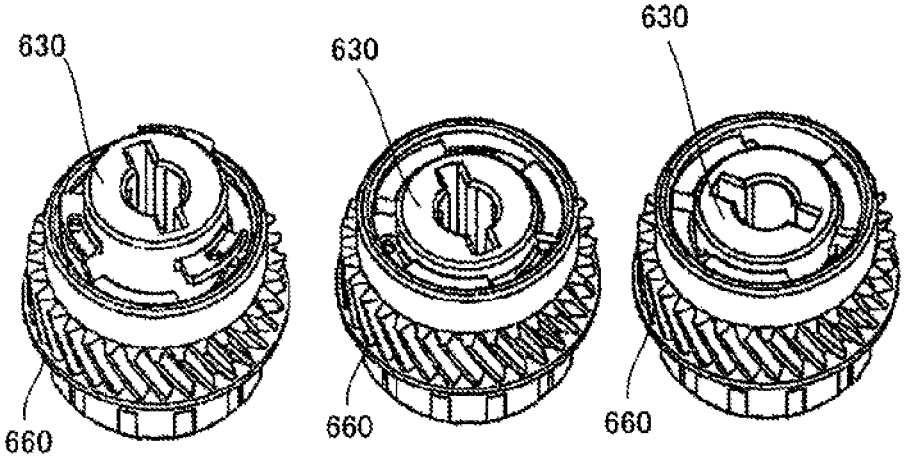
FIG. 35A to FIG. 35C are views showing on embodiment of an assembly process of an intermediate member and a gear member used in a transmission device.

As can be understood from FIG. 35A to FIG. 35C, the intermediate member 630 can be assembled with the gear member 660 by aligning the protrusions 634 such that the intermediate member 630 is axially inserted into the gear member 660 and the protrusions 634 pass between the adjacent receiving members 668 until contacting the inner wall ledges 466. After the protrusions 634 contact the inner wall ledges 466, the intermediate member 630 rotates in a first direction (counterclockwise, from FIG. 35B to FIG. 35C) in response to the gear member 660 such that each protrusion 634 passes underneath the corresponding receiving member 668. When the intermediate member 630 is rotated, the projections 668*a* travel within the depressions 634*b*. In the present embodiment, the projections 668*a* contact the depressions 634*b* when the intermediate member 630 is rotated.

When the intermediate member 630 is further rotated, the projections 668*a* enter the depressions 634*b*, and the projections 668*a* are retained therein via a snap fit, friction, or an interference fit. In one embodiment in which the elastic member 50 is positioned between the intermediate member 630 and the gear member 660, the elastic member biases the projections 668*a* into the depressions 634*b* to help maintain the projections 668*a* within the depressions 634*b*.

In another embodiment of the transmission device 500, as shown in FIG. 36 to FIG. 38B, a gear member 760 may be used instead of the gear member 560 and an intermediate member 730 may be used instead of the intermediate member 530. Except for the differences shown below, the gear member 760 is the same as the gear member 560 and the intermediate member 730 is the same as the intermediate member 530.

Figure 36:
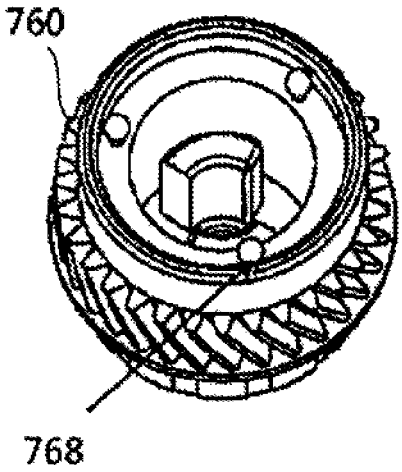
FIG. 36 is a view showing one embodiment of a gear member used in a transmission device.

As shown in FIG. 36, the gear member 760 includes receiving members 768 instead of the receiving members 568 described above. Each receiving member 768 is a projection extending from the top face of the inner wall ledge 466. In this embodiment, the receiving member 768 is a spherical member positioned on a shaft extending from the inner wall ledge 466. However, a different shape may be used.

Figure 37:
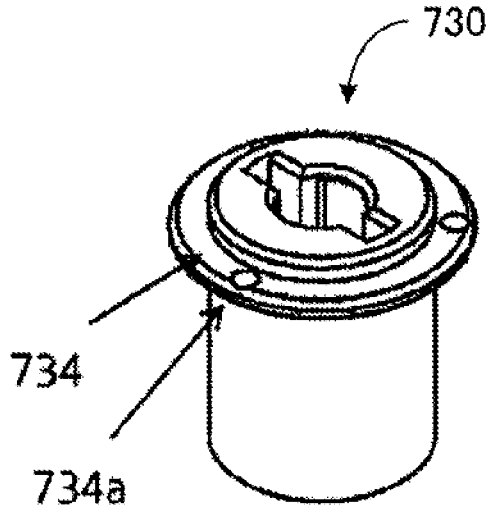
FIG. 37 is a view showing one embodiment of an intermediate member used in a transmission device.

As can be seen in FIG. 37, the intermediate member 730 includes a protrusion 734 extending radially outward from the cylindrical body. In the illustrated embodiment, one protrusion of the cylindrical body is provided. Alternatively, one or more protrusions that do not extend continuously around the circumference may be used. The protrusion 734 includes a plurality of openings 734*a*.

Figures 38A, 38B:
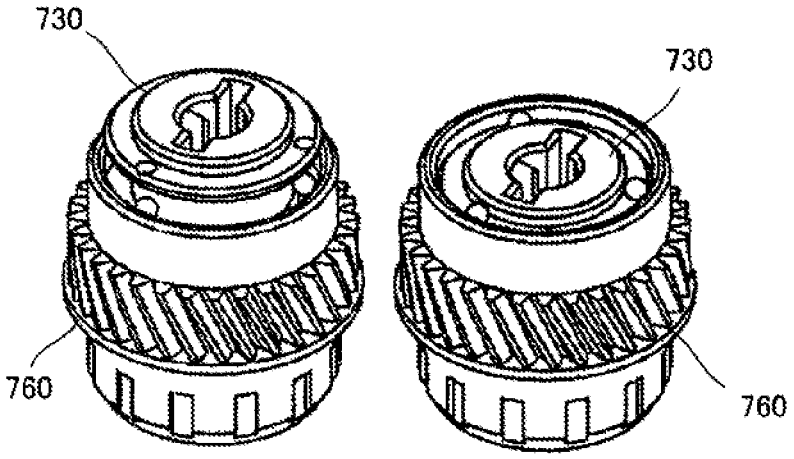
FIG. 38A and FIG. 38B are views showing one embodiment of an assembly process of an intermediate member and a gear member used in a transmission device.

As can be understood from FIG. 38A and FIG. 38B, the intermediate member 730 is assembled with the gear member 760 by aligning the openings 734*a* with the receiving members 768 and pressing the intermediate member 730 in the axial direction onto the gear member 760 such that the receiving members 768 pass through the openings 734*a*. The diameter of the openings 734*a* may be slightly smaller than that of the receiving members 768 such that the intermediate member 730 is snap fit onto the gear member 760.

Figure 39A:
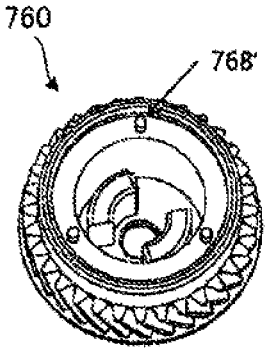
FIG. 39A to FIG. 39C are views showing one embodiment of an intermediate member and a gear member used in a transmission device and their assembly process.
Figure 39B:
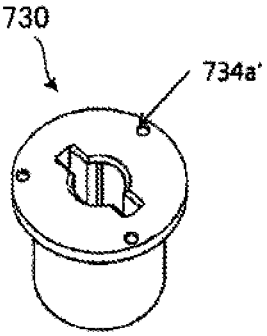
Figure 39C:
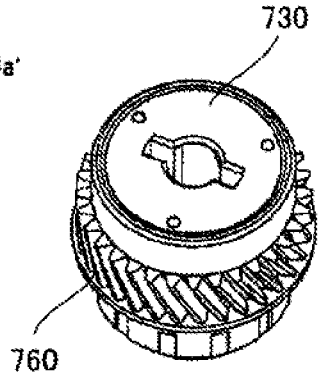

In another embodiment, as shown in FIG. 39A to FIG. 39C, receiving members 768' are cylindrical and the diameter of the openings 734*a* is the same as the diameter of the receiving members 768'. Thus, the receiving members 768' and the openings 734*a'* are engaged with each other by a friction fit to retain the intermediate member 730 on the gear member 760.

In another embodiment, instead of the openings 734*a*, projections having the same shape as the receiving members and extending from the bottom face of the protrusion 734 may be used. The inner wall ledge 466 of the gear member 760 may have openings to receive the projections from the intermediate member 730.

A transmitter such as the transmitter 420 or the transmitter 520 may be used together with the gear members 660 and 760 and the intermediate members 630 and 730 discussed above. Moreover, the intermediate members 630 and 730 may be modified as necessary and used together with other transmission members including the transmission member described in Background Art of the present application. For example, the intermediate members 430, 530, 630 and 730 may be modified such that the cylindrical body does not cover the guiding grooves 324. Thus, the pin 40 may be inserted through the intermediate member to hold the transmitter in place after the transmitter is assembled with the intermediate member.

In another embodiment of the transmission device, the intermediate member may be welded to the gear member, for example, by ultrasonic welding. After the gear member and the intermediate member are assembled, the surfaces of the components engaging with each other are joined via ultrasonic welding. For example, the ultrasonic welding can be performed between the receiving members 768' and the openings 734*a'* in the embodiment show in FIG. 39A to FIG. 39C. The ultrasonic welding may be combined with the above-described embodiment of the friction fit or the snap fit in order to make the assembly between the transmission device and the gear member last longer and to assure proper orientation of the transmission device. Proper alignment can also be assured by pins, or raised portions which communicate with corresponding recesses in the mating part. The size and shape of such projections and recesses are not important.

Figure 40:
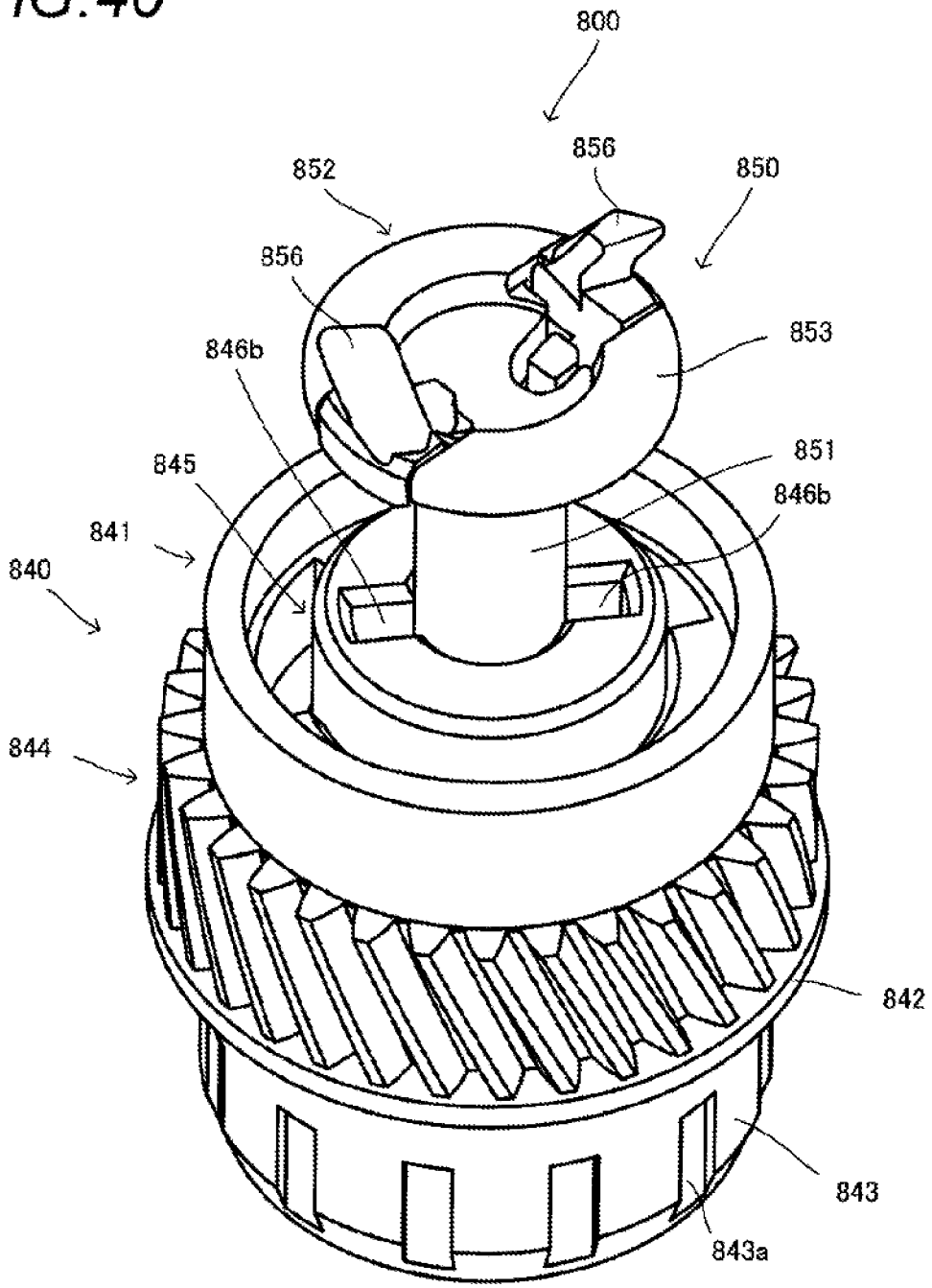
FIG. 40 is a perspective view of a transmission device.
Figure 41:
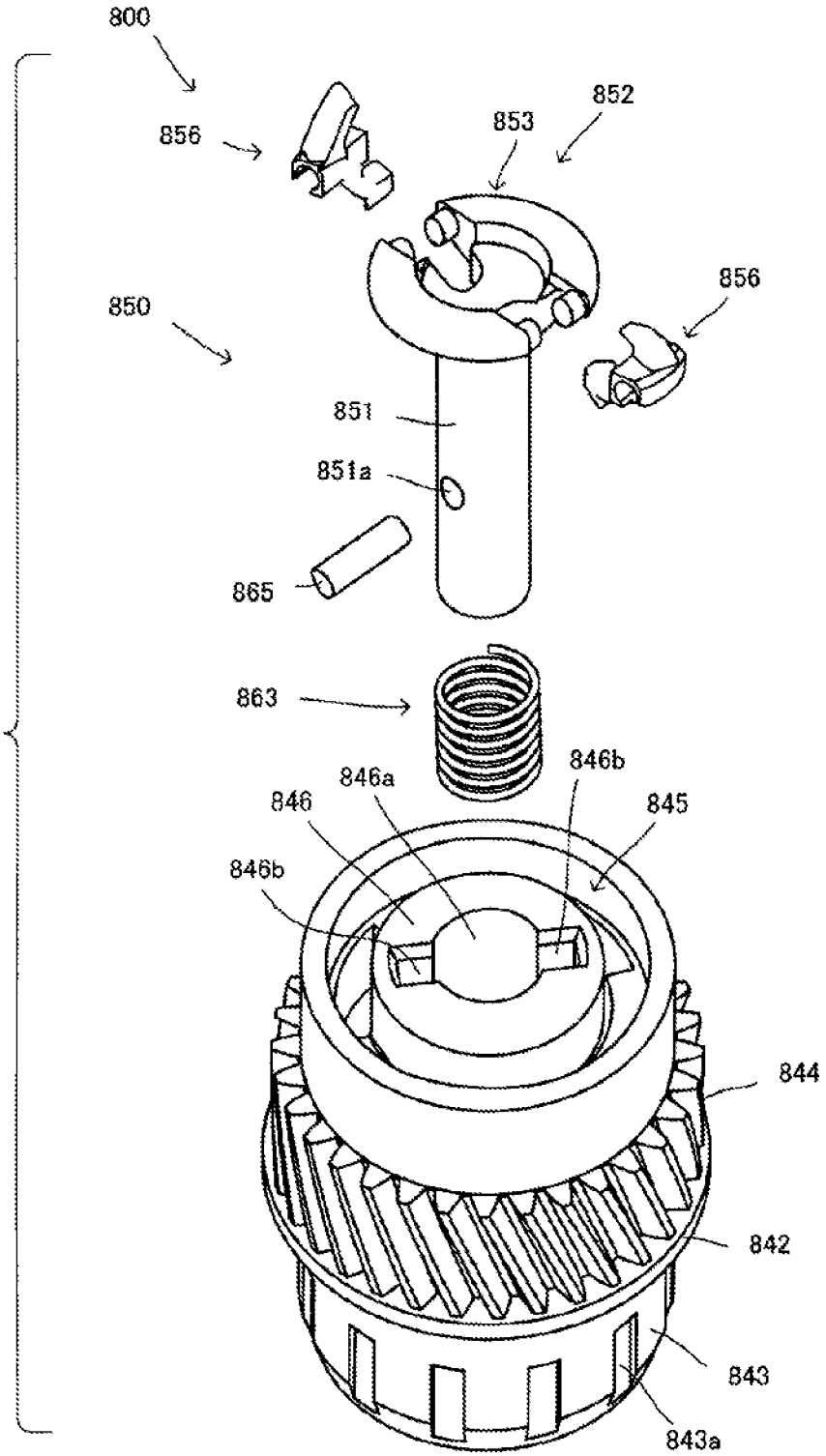
FIG. 41 is an exploded perspective view of the transmission device.

FIG. 40 shows a perspective view of a transmission device 800 of another embodiment, and FIG. 41 similarly shows an exploded perspective view of the transmission device 800 of the another embodiment. Of the transmission device 800, an intermediate member 840 is formed so as to have an upper portion 841, a shell 842, a bottom 843, a gear portion 844 and a body 845.

The upper portion 841 is a generally cylindrical member, the shell 842 and the gear portion 844 are disposed thereoutside, and the body 845 is formed thereinside.

From a part of the outer peripheral surface of the upper portion 841, the shell 842 that contacts an end surface of the photosensitive drum 10 for locking is provided upright. Thereby, the depth of insertion of the transmission device 800 into the photosensitive drum 10 is restricted in a posture where the transmission device 800 is mounted on the photosensitive drum.

Moreover, of the upper portion 841, one side with the shell 842 in between is the bottom 843 inserted into the photosensitive drum 10. The bottom 843 is inserted into the photosensitive drum 10, and fixed to the inside surface of the photosensitive drum 10 by an adhesive agent. Thereby, the transmission device 800 is fixed to an end portion of the photosensitive drum 10. Therefore, the outside diameter of the bottom 843 is substantially the same as the inside diameter of the photosensitive drum 10 within a range where insertion into the cylindrical shape of the photosensitive drum 10 is possible. The bottom 843 may have grooves 843*a* formed on the outer peripheral surface. Thereby, the grooves are filled with an adhesive agent, so that the adhesive property between the upper portion 841 (the transmission device 800) and the photosensitive drum 10 is improved by an anchor effect or the like.

On the outer peripheral surface of the upper portion 841 on the opposite side to the bottom 843 with the shell 842 in between, the gear portion 844 is formed. The gear portion 844 is a gear that transmits a rotative force to another member such as a developing roller, and in the present embodiment, a helical gear is disposed. However, the kind of the gear is not specifically limited; a spur gear may be disposed or both may be disposed so as to be arranged along the axial direction of the upper portion. Moreover, the gear is not necessarily provided.

The body 845 is a part formed inside the upper portion 841 and having the function of retaining an axis member 850 on an intermediate member 840. The body 845 has an axis retaining member 846.

The axis retaining member 846 is a member where an axial hole 846*a* in which the axis member 850 is inserted is provided inside the upper portion 841, and further, two grooves 846*b* are formed so as to be opposed. Since a shaft 851 of a transmitter 852 passes therethrough as described later, this opening 846*a* has a size and shape where the shaft 851 can pass through. Moreover, the groove 846*b* is a groove that is open in a direction opposed to the axis of the upper portion 841 and extending in a direction along the axis of the upper portion 841. As described later, the protruding end portion of a pin 865 is inserted into this groove 846*b*.

While the material forming the intermediate member 840 is not specifically limited, a resin such as polyacetal, polycarbonate or PPS, or a metal may be used. Here, when a resin is used, in order to improve the stiffness of the component, glass fiber, carbon fiber or the like may be mixed in the resin according to the load torque. Moreover, in order to make the assembly and movement of the axis member smooth, the slidability may be improved by including at least one kind of fluorine, polyethylene and silicon rubber in the resin. Moreover, resin may be coated with fluorine, or a lubricant may be applied.

Of the transmission device 800, the axis member 850 will be described. The axis member 850 includes the shaft 851 and the transmitter 852. Further, the axis member 850 is provided with an elastic member 863 and a pin 865. The elastic member 863 of the present embodiment is a coiled spring.

Hereinafter, each will be described.

The shaft 851 is a cylindrical member. The outside diameter thereof is a size that allows insertion into the axial hole 846*a* provided on the body 845 of the above-described intermediate member 840. Moreover, the shaft 851 is provided with an opening 851*a* passing through orthogonally to the axial direction. Into this opening 851*a*, the pin 865 is inserted.

The transmitter 852 is a member that receives the rotational driving force from the device body and transmits the driving force to the shaft 851 when the transmission device 800 comes to take a predetermined posture. In the present embodiment, the transmitter 852 is disposed on the end portion of one side (the side not inserted in the intermediate member 840) of the shaft 851, and is formed so as to have a disc-like base 853 and two engagement blocks 856.

Figure 42:
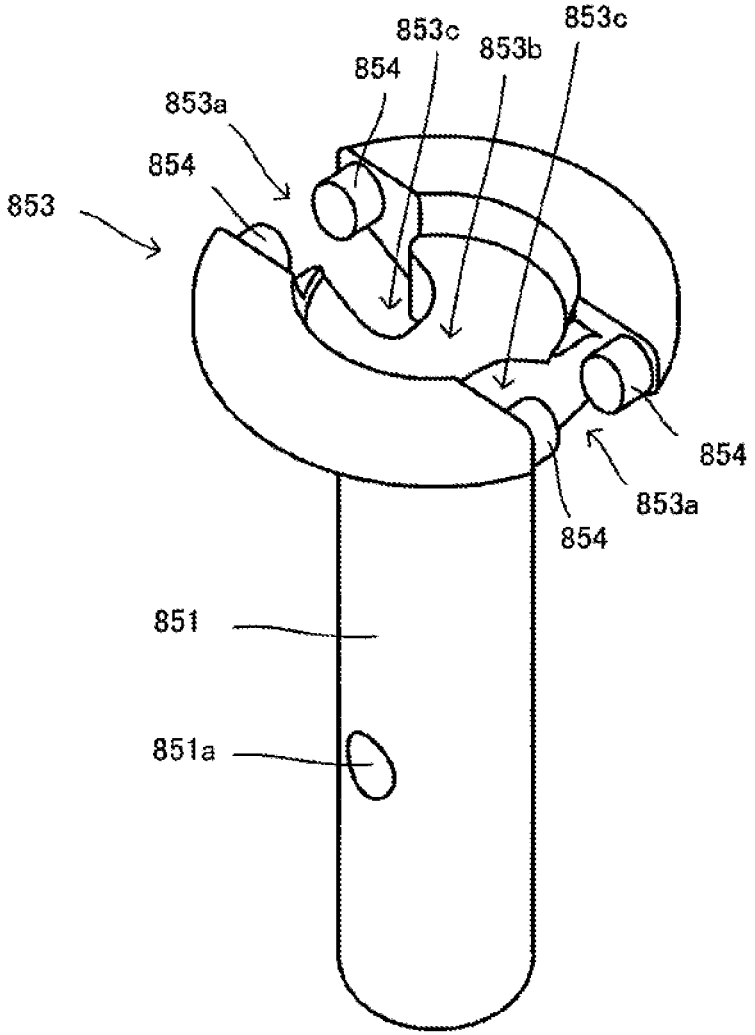
FIG. 42 is a perspective view of a shaft and a base.
Figure 43A:
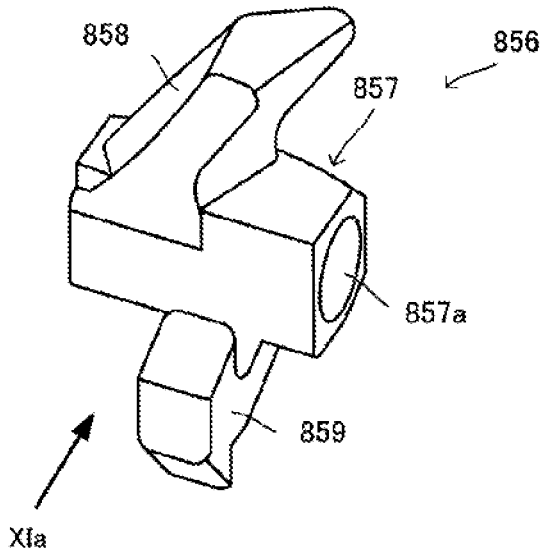
FIG. 43A is a perspective view of an engagement block.
Figure 43B:
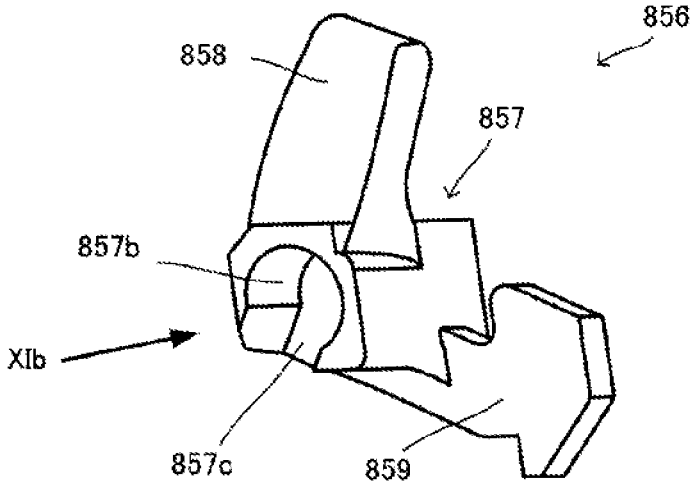
FIG. 43B is another perspective view of the engagement block.
Figure 44A:
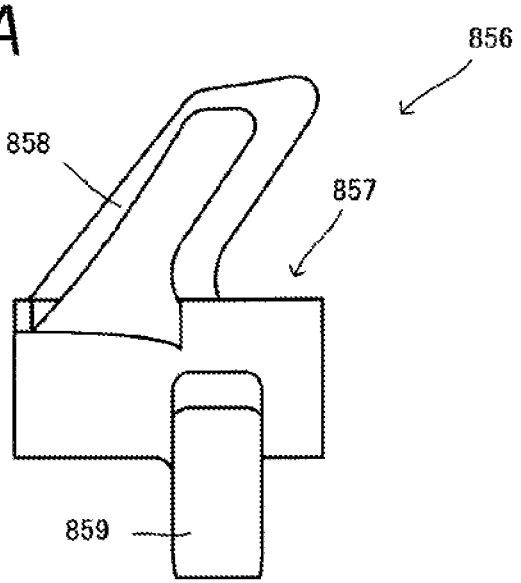
FIG. 44A is a side view of the engagement block.
Figure 44B:
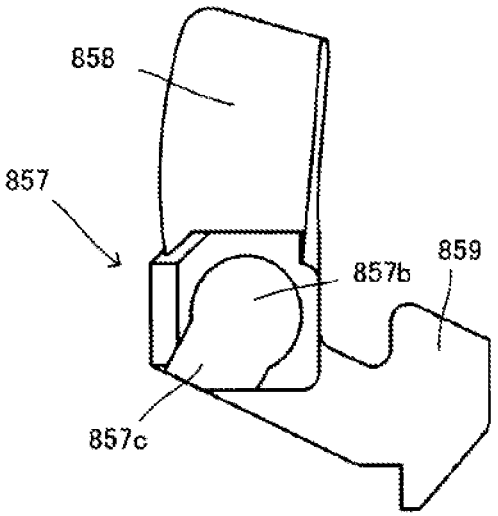
FIG. 44B is a front view of the engagement block.

FIG. 42 shows a perspective view of the shaft 851 and the base 853, FIG. 43A and FIG. 43B show perspective views of the engagement block 856, FIG. 44A shows a view viewed from a direction shown by an arrow XIa in FIG. 43A, and FIG. 44B shows a view viewed from a direction shown by an arrow XIb in FIG. 43B.

The base 853 is a disc-like member, and is disposed coaxially with the shaft 851 on the end portion of one side (the side not inserted in the intermediate member 840) of the shaft 851. The outer circumference of the base 853 is formed so as to be larger than the outer circumference of the shaft 851.

On the base 853, two receptacles 853*a* formed so as to face each other in a direction orthogonal to the axis are formed. The receptacles 853*a* are open at the outer peripheral portion of the base 853. Of the receptacles 853*a*, the facing wall surfaces are provided with pins 854 so as to face each other.

In the axial part of the base 853, an inclined receiving space 853*b* is provided such that the axial part is the deepest. Moreover, the portions, communicating with the receptacles 853*a*, of parts of the inclined surface of this receiving space 853*b* are provided with notches 853*c*.

The engagement block 856 includes a columnar shaft 857, and recesses 857*a* and 857*b* are provided at both ends thereof. These recesses 857*a* and 857*b* are formed such that the pins 854 provided on the receptacles 853*a* of the above-described base 853 can be inserted therein.

Moreover, one recess 857*b* is provided with a notch 857*c* communicating with this recess 857*b* from a side surface. By this notch 857*c*, the engagement between the engagement block 856 and the base 853 is facilitated as described later.

As can be understood from FIG. 43A, FIG. 43B, FIG. 44A and FIG. 44B, two protrusions 858 and 859 are provided upright from side surfaces of the shaft 857. These two protrusions 858 and 859 enable a posture of engaging with a driving shaft 870 and a posture of disengaging therefrom in relation with the driving shaft 870 as described later.

Figure 45A:
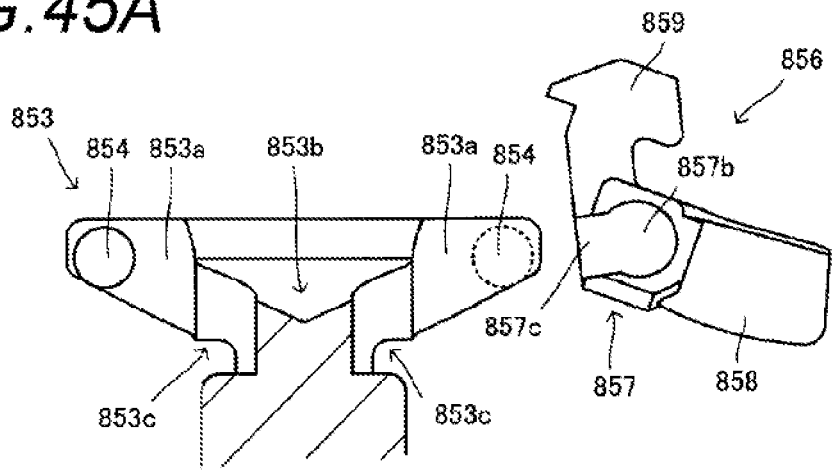
FIG. 45A, FIG. 45B and FIG. 45C are views explaining the assembly of the engagement block to the base.
Figure 45B:
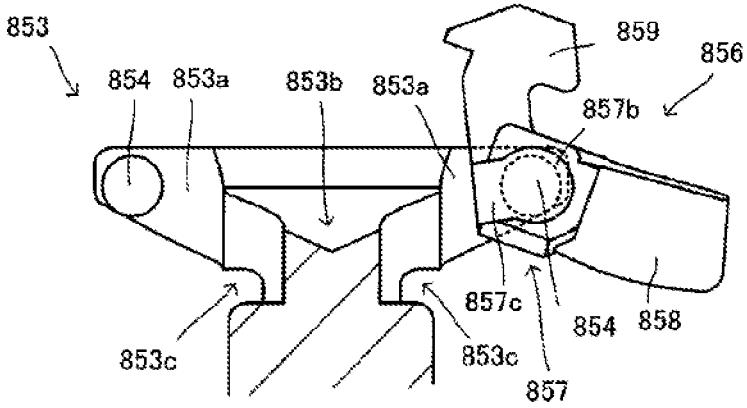
Figure 45C:
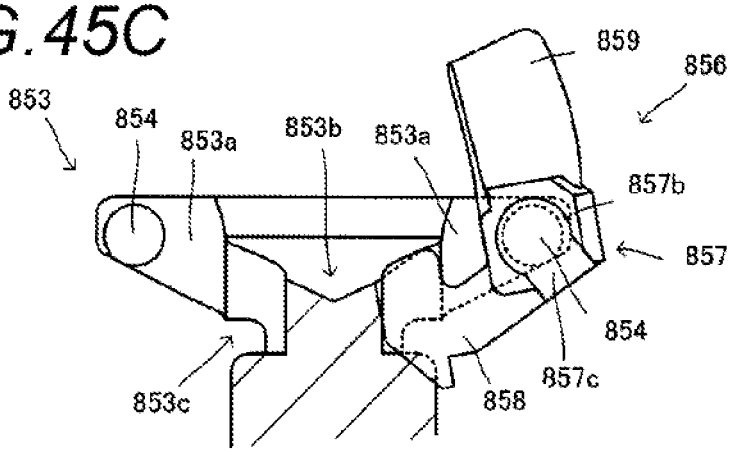
Figure 46:
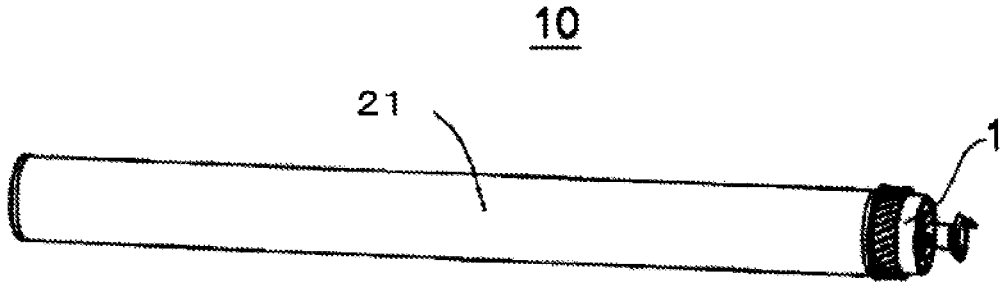
FIG. 46 is a perspective view showing one embodiment of the photosensitive drum.
Figure 47:
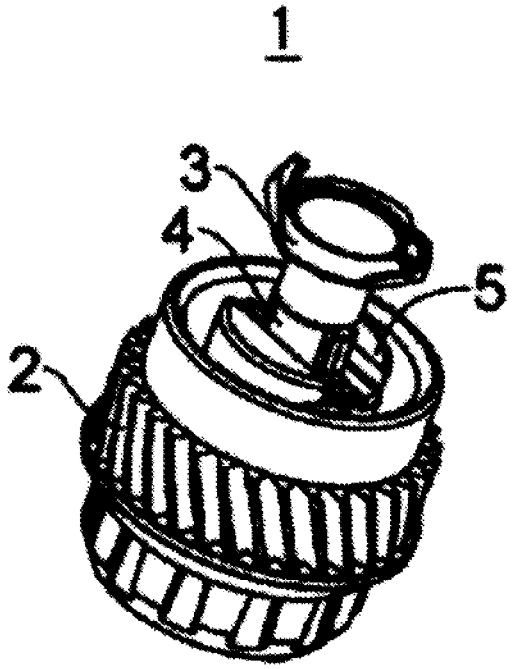
FIG. 47 is a perspective view showing the transmission device of the photosensitive drum of FIG. 46.
Figure 48:
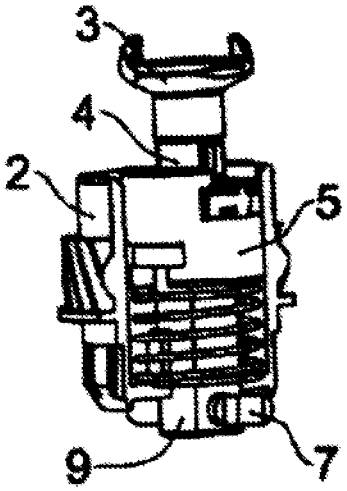
FIG. 48 is a cross-sectional view of the transmission device of FIG. 47.
Figure 49:
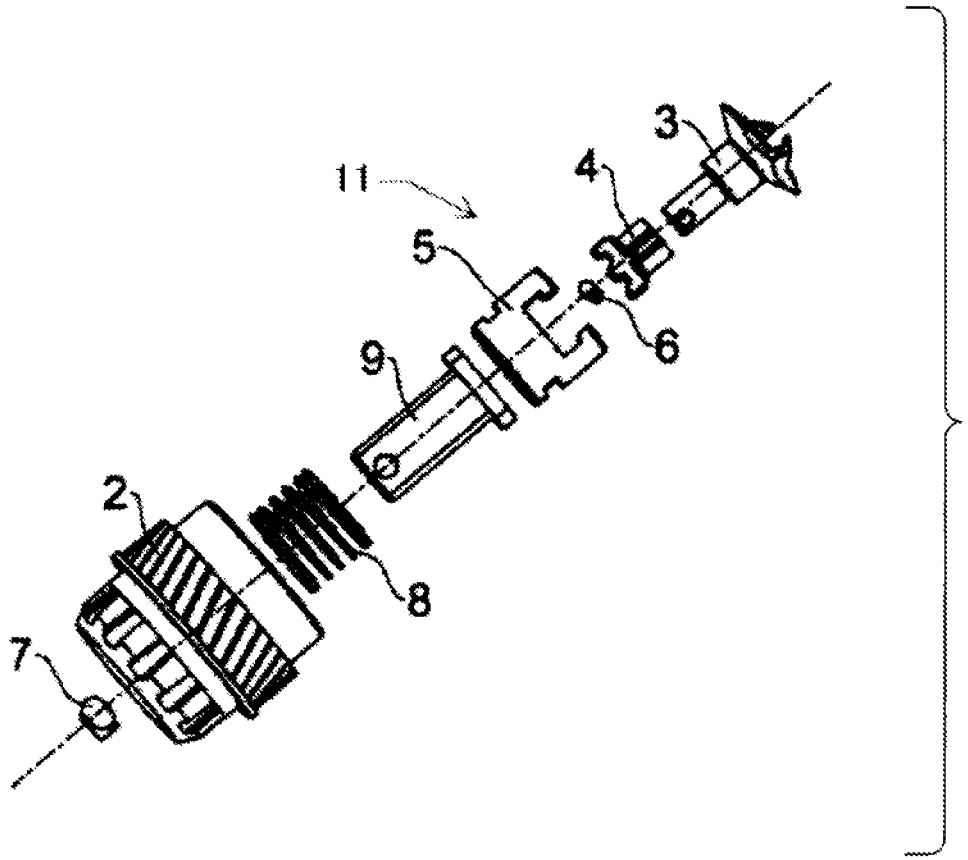
FIG. 49 is an exploded perspective view of the transmission device of FIG. 47.
Figure 50A:
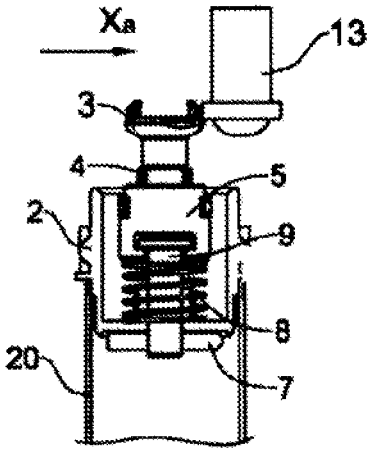
FIG. 50A to FIG. 50D are views showing a scene in which the photosensitive drum of FIG. 46 is engaged with the printer.
Figure 50B:
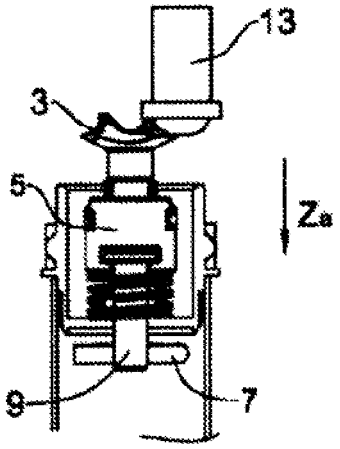
Figure 50C:
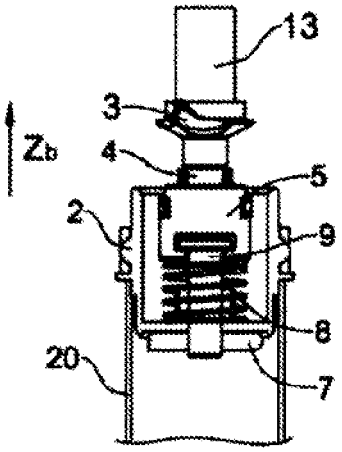
Figure 50D:
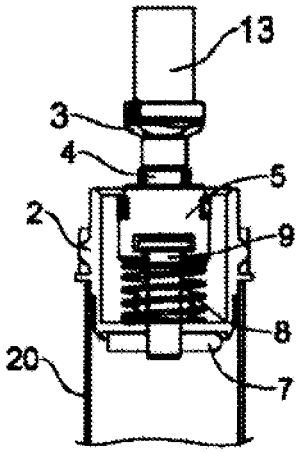
Figure 51:
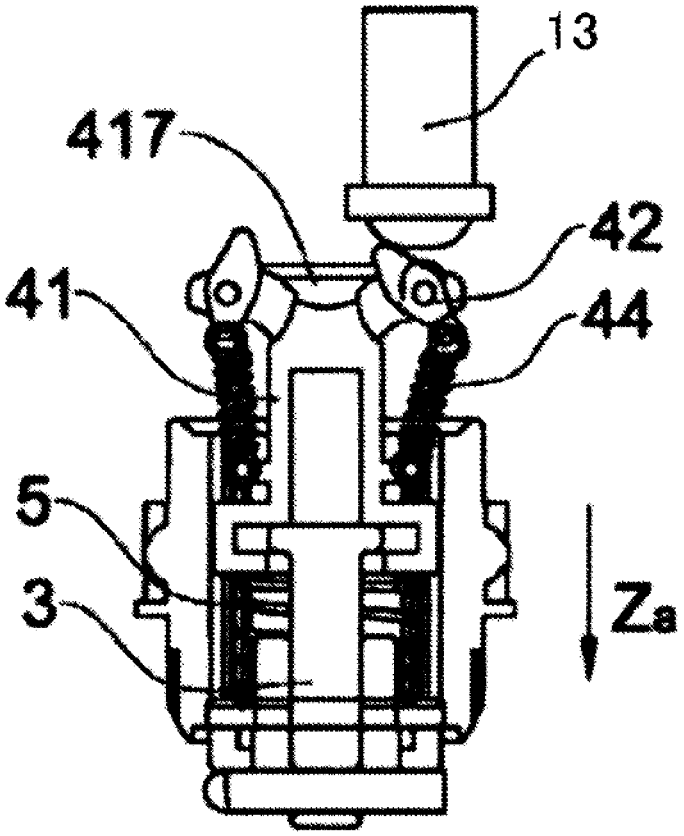
FIG. 51 is a view showing the process in which the photosensitive drum is engaged with the printer.

The base 853 and the engagement block 856 are combined as follows: Views for explanation are shown in FIG. 45A to FIG. 45C. First, as shown in FIG. 45A, positioning is performed such that the protrusion 854 of the base 853 can be inserted into the notch 857*c* provided on the shaft 857 of the engagement block 856. Then after the recess 857*a* on the side that is a blind spot and cannot be seen from FIG. 45A is fitted onto the protrusion 854, as shown in FIG. 45B, the protrusion 854 is inserted into the recess 857*b* from the notch 857*c*. Then, the engagement block 856 is rotated as shown in FIG. 45C. At this time, the protrusion 859 is disposed inside the receptacle 853*a* of the base 853, and the protrusion 858 is situated so as to protrude from the base 853.

This simple structure of the base 853 facilitates the assembly of the engagement block 856 to the base 853 and also enables reduction in component count.

While the material forming each component of the axis member 850 is not specifically limited, a resin such as polyacetal, polycarbonate or PPS may be used. However, in order to improve the stiffness of the component, glass fiber, carbon fiber or the like may be mixed in the resin according to the load torque. Moreover, stiffness may be further improved by inserting a metal in the resin, or the entire component may be formed of a metal.

The structure described above, including the transmitter, the intermediate member and the gear member may each be made of metal and/or plastic. In one embodiment, the gear member and the intermediate member are one member formed of two parts, and the gear member and the intermediate member are each a zinc die-cast part and are united by insert molding such that the intermediate member is not disassembled from the gear member. In another embodiment, the gear member and the intermediate member may each be made of resin and assembled by the above-described method without the use of insert molding. Consequently, the intermediate member can be disassembled from the gear member as necessary such that either part can be replaced. The transmitter can also be disassembled from the intermediate member and the gear member and replaced as necessary.

When any of the transmission devices described herein is used, the shell is fastened to a photosensitive drum installed in a toner cartridge, and the engagement structure of the transmitter sticks out of an end of the toner cartridge. When the user puts the toner cartridge into the housing of the image forming apparatus, a part of the drive member of the image forming apparatus is received in the receiving space and the engagement concaves are received by the two pillars of the drive member of the image apparatus to be engaged, whereby the engagement structure of the transmitter engages with the drive member of the image forming apparatus disposed in the housing. Thereby, the drive member of the image forming apparatus rotates the photosensitive drum.

The embodiments of the transmission device described herein are simpler in structure than the conventional ones, and the way that the transmission device is connected with and separated from the image forming apparatus is different from the conventional ones. By the feature that the transmitter can move along the drum axis L and rotate about the drum axis L at the same time and the characteristic shape of the engagement blocks of the transmitter, no manner what angle the transmission device is assembled to and disassembled from the housing of the image forming, apparatus, the transmitter is firmly assembled to the drive member and is smoothly separated from the drive member.

Details of how the transmission device is connected with and separated from the drive member are disclosed in Patent Literature 7 and are not described in detail herein.

The foregoing description of the embodiments has been used only for the purposes of illustration and description and is not intended to be exhaustive or to limit the present invention to the detailed embodiments disclosed. Many modifications and variations are possible in light of the above teaching.

The above-described embodiments are chosen and described so that one skilled in the art can use the present invention and various embodiments together with modifications suited to contemplated uses by explaining the principles of the present invention and their practical applications. Other embodiments will be made apparent by those skilled in the art without departing from the spirit and scope of the present invention. The scope of the present invention is defined by the appended claims rather than the foregoing description and embodiments.

Reference numerals corresponding to elements described in the embodiment will be listed as below.

1: Driving component (transmission member)
10: Photosensitive drum
20, 20', 20": Transmitter
30, 430, 530, 630, 730: intermediate member
40: Pin

50, 89, 89': Elastic member (elastic ring, spring, holding member)
60: Gear member (shell)
70: Shaft
75: Protrusion
81: Base
82: Engagement block
100, 200, 300, 500, 800: Transmission device
820: Engagement claw

What is claimed is:

1. A transmission device, comprising:

a gear member;

an intermediate member removably attached to the gear member and including a guiding groove; and a transmitter including a shaft, the shaft having at least one protrusion extending radially outward from the shaft, wherein the guiding groove is shaped to limit movement of the protrusion along the guiding groove in an axial direction, while allowing rotation of the transmitter relative to the guiding groove, when the transmission device is assembled.

2. The transmission device according to claim 1, wherein:

the intermediate member includes an introducing groove on a top face of the intermediate member and at least one retention member that forms the guiding groove; and the introducing groove provided on the top face of the intermediate member is sized to allow the protrusion to pass through the introducing groove when the transmitter is assembled to the intermediate member.

3. The transmission device according to claim 2, wherein the guiding groove includes an opening to allow the protrusion to pass through the introducing groove when the transmitter is assembled to the intermediate member.

4. The transmission device according to claim 1, wherein:

at least one inner wall ledge and at least one receiving member are provided on an inside surface of the gear member;

the intermediate member includes at least one protrusion extending radially outward; and the receiving member of the gear member includes an opening to receive the protrusion of the intermediate member.

5. The transmission device according to claim 4, wherein the opening of the receiving member of the gear member is arranged such that the intermediate member is removably attached within the gear member by axially inserting the intermediate member into the gear member and rotating the gear member until the protrusion of the intermediate member is positioned within the opening of the receiving member.

6. The transmission device according to claim 2, wherein:

the at least one retention member of the intermediate member includes a first retention member and a second retention member disposed apart from the first retention member with a gap being formed from the first retention member; and the gap is sized to allow the protrusion to pass through the gap after passing through the introducing groove when the transmitter is assembled to the intermediate member.

* * * * *